US007470174B2

(12) United States Patent
Umeda et al.

(10) Patent No.: US 7,470,174 B2
(45) Date of Patent: Dec. 30, 2008

(54) COMPACT DISTRIBUTION DEVICE FOR SEPARATING A PLURALITY OF COIN DENOMINATIONS

(75) Inventors: Masayoshi Umeda, Saitama (JP); Minoru Enomoto, Saitama (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/583,591

(22) Filed: Oct. 19, 2006

(65) Prior Publication Data

US 2007/0087675 A1 Apr. 19, 2007

(30) Foreign Application Priority Data

Oct. 19, 2005 (JP) ..... 2005-305055

(51) Int. Cl.
*G07D 3/00* (2006.01)
*G07D 3/14* (2006.01)

(52) U.S. Cl. ..... 453/3; 194/346

(58) Field of Classification Search ..... 453/3, 453/4, 56, 34, 35, 36, 49, 63, 18, 29, 30; 209/509, 695, 696, 698, 707; 193/13, 14, 193/31 R, 31 A, DIG. 1
See application file for complete search history.

(56) References Cited

U.S. PATENT DOCUMENTS 1,813,296 A * 7/1931 Kidwell ..... 453/12
3,361,141 A * 1/1968 Weisskopf ..... 453/11
4,635,661 A * 1/1987 Uematsu et al. ..... 194/217
5,901,828 A * 5/1999 Monie ..... 194/346
5,910,044 A 6/1999 Luciano, Jr. et al.
6,039,643 A * 3/2000 Kurosawa et al. ..... 453/3

FOREIGN PATENT DOCUMENTS

| | | |
|---|---|---|
| DE | 3627387 | 2/1988 |
| DE | 4204337 | 8/1993 |
| FR | 2650417 | 2/1991 |
| GB | 2386734 | 9/2003 |
| JP | 06-274734 | 9/1994 |
| JP | 11-328470 | 11/1999 |

* cited by examiner

*Primary Examiner*—Patrick Mackey
*Assistant Examiner*—Mark Beauchaine

(57) ABSTRACT

A compact coin distribution device is capable of separating a plurality of coin denominations that are stored in bulk. A separator feeding device removes the coins in a one-by-one manner to a transfer device for translating the coins in one direction. The denomination of the coins can be sensed and a plurality of coin selecting ports can be aligned on either side of a coin transfer path. A plurality of movable guide members form a support for the coins both at the bottom and side of the coins. An activating unit can selectively activate a specific guide member, to thereby enable a specific coin to be released into a specific coin selecting port. The ability of the coins to be released on either side of the transfer path enables an efficient and compact configuration.

16 Claims, 13 Drawing Sheets

COMPACT DISTRIBUTION DEVICE FOR SEPARATING A PLURALITY OF COIN DENOMINATIONS

BACKGROUND OF THE INVENTION

1. Field of the Invention

The present invention relates to a distribution device for distributing a plurality of mixed denomination coins in a bulk state, and more particularly, to a compact device fo distributing the coins of multiple denominations.

2. Description of Related Art

It has been known that coins of multiple denominations provided in bulk storage can be separated and fed by a rotating disk including a plurality of coin intake holes one by one, and after that, the coins are moved along a transferring route by coin feeding pins on a transferring chain moving in a predetermined direction. The coin denominations are discriminated, and based on the discriminated denominations disposed in series, and an extracting device is operated for each denomination, so that the coins are dropped into a coin storage portion for each predetermined denomination, see Japanese Patent No. 3247185 and Japanese Patent Application Laid-Open No. 11-328470.

SUMMARY OF THE INVENTION

Since a coin deposit machine including a distribution device for each denomination of this type is installed close to a Point of Sale (POS) register, it is required to be miniaturized as much as possible. In the conventional technology, since a selecting portion for each denomination is installed in a row, when the coin denominations become numerous, a problem arises in that the device can become a larger size than desired.

For example, when a selection object is a Japanese Yen, the selecting portions of six denominations are installed six pieces in series, and in the case of Euro, the selecting portions of eight denominations are installed eight pieces in series. As a result, the device becomes long in depth, and a problem arises that the device becomes large-sized.

One approach to this problem is to make the coin transferring route U-shaped, with the transferring device and the transferring route being juxtaposed, however, while the depth may become shorter, the width must increase, and a problem arises that the device still becomes large in size.

A first object of the present invention is to make a coin distribution device for plural denominations of coins compact.

A second object of the present invention is to provide a distribution device for each denomination of the coins, which is highly accurate in distributing the coin and is suitable for a small-sized coin deposit device.

To achieve these objects, a coin denomination discriminating device can be configured as follows. A coin distribution device for each denomination, the device for distributing coins for each denomination in the midst of transferring the coins of multiple denominations on a passage, while arranging them in a row by a transferring device, wherein a plurality of selecting ports are disposed by facing the transferring route and shifting in a direction orthogonal to the extending direction of the transferring route, and the selection ports are selectively opened.

In this configuration, the coins are transferred sequentially in a row in the transferring route by the transferring device. A plurality of selecting ports are disposed to face the transferring route and shifting in a direction orthogonal to the extending direction of the transferring route. Consequently, since a plurality of selecting ports are disposed for the transferring route in the predetermined position of the transferring route, the selecting ports are selectively opened, so that multiple denominations can be selected. In other words, multiple denominations can be selected adjacent one place on a single direction transferring route of the coins.

Consequently, the depth of the device can be made short, and at the same time, since the transferring device and the coin passages are not U-shaped, the width can be made narrow, and as a result, there is an advantage in that the device can be made compact.

A coin distribution device for each denomination, comprising: a storage member for storing coins in bulk, a separator feeding device for removing coins from the storage member in a one-by-one manner, a transferring device for moving the coins of multiple denominations in a predetermined direction; a guide rail for guiding the coins moved by the transferring device; first selecting ports configuring a part of said guide rail; second selecting ports disposed at a lateral side of the transferring device side against the first selecting ports and facing the passage of the coins moved by the transferring device; and a control device or activating unit for selectively opening the first selecting ports and the second selecting ports. In this configuration, the coins are guided along the guide rail by the transferring device. Since a part of this guide rail is disposed with the first selection port, the first selecting port is opened, so that one of the denominations is selected.

Further, since the second selecting port is disposed in the lateral direction of the transferring device side against the first selecting port, this second selecting port is opened, so that another denomination is selected. In other words, since multiple denominations can be selected at one place of the selecting route, the depth of the device can be made short, and since the transferring device and the route are not U-shaped, the depth of the width can be made narrow, as a result, there is the advantage that the device can be made compact.

A coin distribution device for each denomination, characterized by comprising: a transferring device for moving the coins of multiple denominations in a predetermined direction; a guide rail for guiding the coins moved by the transferring device; a first selecting port configuring a part of the guide rail; a second selecting port disposed at the opposite side sandwiching the transferring device against the first selecting port and facing the transferring route of the coins moved by the transferring device; and a control device for selectively opening the first selecting port and the second selecting port. In this configuration, the coins guided on the peripheral surface of the guide rail are dropped into the first selecting port by opening the first selecting port which is a part of the guide rail, and are selected. Further, by opening the second selecting port disposed at the opposite side of the first selecting port against the transferring device, the coins are dropped into the second selecting port, and are selected.

In other words, the coins transferred by the transferring device are selected for a predetermined denomination only at the same predetermined position of the transferring device by dropping into the first selecting port on one side. The coins of other predetermined denominations only are selected by dropping into the second selecting portion on another side of the transfer route. Hence, according to the present configuration, since the coins of the predetermined denominations can be distributed on two sides at the same place as the transferring device, the transfer distance of the coins can be made short, thereby obtaining an advantage in that the device can be made compact.

A coin distribution device for each denomination, characterized by comprising: a transferring device for moving the coins of multiple denominations in a predetermined direction; a guide rail for guiding the coins moved by the transferring device; a first selecting port configuring a part of the guide rail; a guide plate disposed the lower side of the guide rail; a first movable guide rail disposed at the first selecting port and making a sharp angle at the guide plate, and moreover, guiding the lower side peripheral surface of the coin; a second selecting port disposed at the lateral direction of the transferring device side against the first selecting port and facing the transferring route of the coins moved by the transferring device; a second movable guide plate disposed at the second selecting port and guiding the under surface of the coin; and a control device for selectively moving the first selecting port guide rail and the second selecting port guide rail. According to the present configuration, the coin has one surface guided by the guide plate, and is advanced by the transferring device, while the peripheral surface is guided by the guide rail. In the midst of advancing, when the first selecting port guide rail configuring the guide rail is guided to a non-guiding position, the coin guided by the guide rail is not guided by the first selecting port guide rail, and therefore, it drops into the first selecting port, and is selected.

On the other hand, when the second selecting port guide rail disposed in the guide plate is moved to the non-guiding position, the coin guided by the guide plate is not guided by the guide plate, and therefore, it drops into the second selecting portion, and is selected. Consequently, the coins of the predetermined denominations can be distributed to two places of one side of the same place of the transferring device and the other side, and therefore, the transferring distance of the coin can be made short, thereby obtaining an advantage in that the device can be made compact.

A coin distribution device for each denomination, characterized by comprising: a transferring device for moving the coins of multiple denominations in a predetermined direction; a first selecting port guide rail inclining at approximately 45 degrees in a horizontal line, and making a sharp angle at the guide plate for guiding the under surface of the coin moved by the transferring device and the guide plate, and guiding the lower side peripheral surface of the coin; a first selection port configuring a part of the guide rail; a second selecting port disposed at the lateral direction of the transferring device side opposite the first selecting port and facing the transferring route of the coins moved by the transferring device; and a control device for selectively opening the first selecting port and the second selecting port. In this configuration, the coin has the under surface guided by the guide plate, and it is moved by the transferring device, while the peripheral surface is guided by the guide rail. When the first selecting portion guide rail configuring a part of the guide rail is moved to the non-guiding position, the coin slips off by the inclination of the guide plate, and drops into the first selecting portion, and is selected.

When the second selecting port guide plate configuring a part of the guide plate is moved to the non-guiding position, the coin drops downward by a gravitational force of the guide plate, and drops off into the second selecting port, and is selected. Consequently, since the coins of the predetermined denominations can be distributed to two sides of the same place on the transferring device, the transferring distance of the coin can be made short, and furthermore, since the guide plate is inclined at approximately 45 degrees, when the coin drops into the first selecting port, an appropriate dropping speed can be obtained without increasing the height of the guide plate, thereby obtaining an advantage in that the device can be made compact.

A coin distribution device for each denomination, characterized by comprising: a transferring device for moving the coins of multiple denominations in a predetermined direction; a guide rail inclining at approximately 45 degrees in a horizontal line, and making a sharp angle at the guide plate for guiding the under surface of the coin moved by the transferring device and the guide plate, and guiding the lower side peripheral surface of the coin; a first selection port configuring a part of the guide rail; a first selecting port guide rail disposed at the first selecting port, making a sharp angle at the guide plate, and guiding the lower side peripheral surface of the coin, a second selecting port disposed at the opposite side sandwiching the transferring device against the first selecting port and facing the transferring route of the coin moved by the transferring device; a second selecting port guide rail disposed at the second selection port and guiding the under surface of the coin; and a control device for selectively moving the first selecting port guide rail and the second selecting port guide rail. By this configuration, since the guide plate is inclined approximately 45 degrees, the one surface of the coin transferred by the transferring device slides on the guide plate, and the peripheral surface is moved on the guide rail, while sliding.

In other words, the coin is prevented by the guide rail from moving downward along the guide plate by self-load, and is transferred while the movement downward is guided by the guide plate. The first selecting port is opened at a part of the guide rail, and though this is usually closed by the first selecting port guide rail making a sharp angle at the guide plate, when the coin of a predetermined denomination is selected, the first selecting port guide rail is moved to the non-guiding position deviated from a blunt angle at the guide plate or the extension of the guide rail. When the first selecting port guide rail moves to the non-guiding position, since the peripheral surface of the coin is not supported by the first selecting port guide rail, the coin drops along the inclined guide plate, and drops into the first selection port, and is selected.

On the other hand, the second selecting port is disposed at the guide plate of the opposite side sandwiching the transferring device against the first selecting port, and though usually closed by the second selecting port guide rail, when the coin of the predetermined denomination is selected, the second selecting port guide rail is moved to the non-guiding position.

When the second selecting guide rail moves to the non-guiding position, the coin moving rest against the guide plate is not guided by the second selecting port guide rail, the coin drops into the second selecting port by self-load, and is selected. Consequently, since the coins of two types are selected for one side sandwiching the transferring device and the other side, the transferring distance of the coin can be made short, and as a result, there is an advantage that the device can be made compact.

A coin distribution device for each denomination, which is a device for distributing coins for each denomination in the midst of discriminating a denomination by a denomination discriminating device after separating and feeding coins inputted in a bulk-load state one by one by a separate feeding device and transferring these coins on a transferring route while arranging them in a row, wherein a plurality of selecting ports are disposed by facing the transferring route and shifting in a direction orthogonal to the extending direction of the transferring route, and the selecting ports are selectively opened. By this configuration, the coins discriminated by denomination by the denomination discriminating device are separated one by one by the transferring device, and is transferred to the transferring route.

A plurality of selecting ports equal to the number of coin denominations are disposed at positions of a predetermined distance in the transferring route and shifting in a direction orthogonal to the transferring route, and are selectively opened based on the coin discrimination of the denomination discriminating device. Consequently, multiple denominations can selectively drop into appropriate selecting ports, and therefore, there is an advantage that the device can be made compact and efficient.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
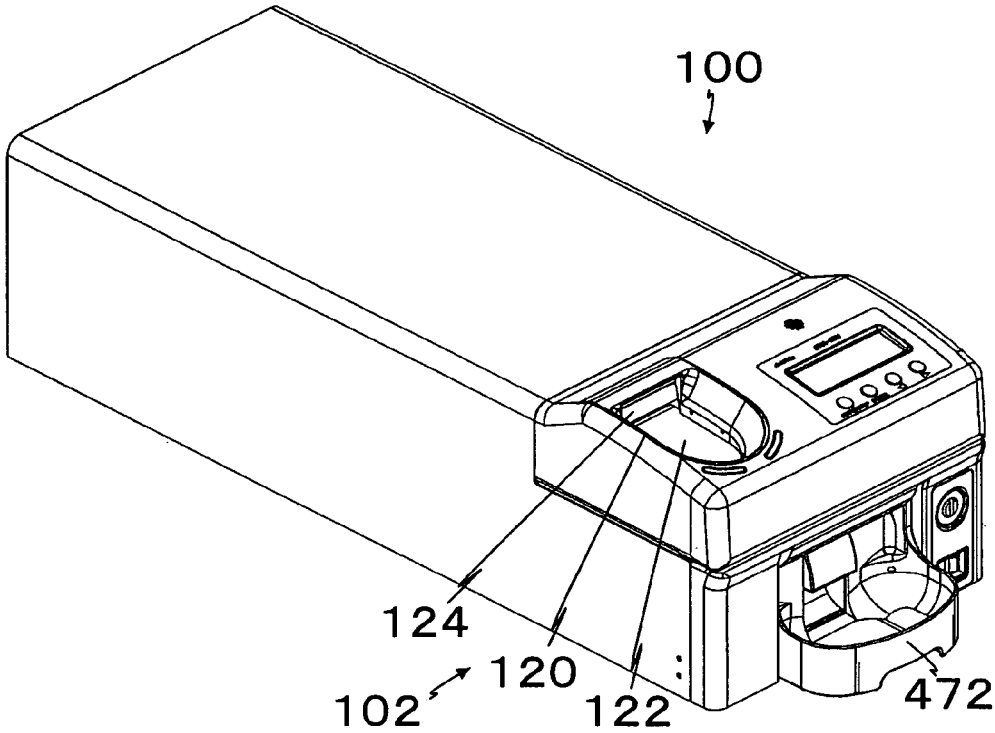
FIG. 1 is a perspective outline oblique view of a coin deposit payment machine in which a distribution device for each denomination of the coins of an embodiment of the present invention is used.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The "coin" used in the present specification includes a token, a medal and the like in addition to a monetary coin, and the shape thereof includes circular and polygonal forms.

The present disclosed invention can be a compact denomination discriminating device of coins, comprising: a transferring device for moving coins of multiple denominations in a predetermined direction; a guide rail inclined at an angle of approximately 45 degrees to a horizontal plane and making a sharp angle at a guide plate for guiding the undersurface of the coin moved by the transferring device and the guide plate, and guiding the lower side peripheral surface of the coin; a first selecting port configuring a part of the guide rail; a first selecting port configuring a part of the guide rail; a first selecting port guide rail disposed at the first selecting port and making a sharp angle at the guide plate, and guiding the lower side peripheral surface of the coin; a second selecting port disposed at the opposite side sandwiching the transferring device against the first selecting port and at the guide plate; the second selecting port guide rail disposed at the second selecting port and guiding the undersurface of the coin: and a control device for selectively moving the first selecting port guide rail and the second selecting port guide rail.

The present disclosed embodiment can be an example of a distribution device for a coin deposit payment device which can accommodate eight denominational types of coins such as 2 Euro, 1 Euro, 50 Cent, 20 Cent, 10 Cent, 5 Cent, 2 Cent, and 1 Cent which are the currency of the European community, and holds each denomination to pay out a predetermined number of coins of the predetermined denominations based on a delivery support system.

However, the present invention can also be used for a coin deposit machine for accommodating the coins of multiple denominations and storing them for each denomination.

A description of a coin deposit payment device 100 will be described with reference to FIGS. 1 and 2.

The coin deposit payment device 100 includes a deposit device 102, a separate feeding device 104, a denomination discriminating device 106, a transferring device 108, a selecting portion 110, a storing portion 112 and a payout device 114.

First, the deposit device 102 will be described. The deposit device 102 has functions of feeding coins of multiple different denominations that are inputted into a D-shaped input port 120 in a bulk-load state to the separate feeding device 104 of the next process in a range not exceeding of coin capacity of a separate feeding device 104 of the next process step. Specifically, the device 102 includes a deposit flat endless belt 122, a coin break-up roller 124, and an electric motor 126 for driving the deposit flat belt 122. The deposit flat belt 122 has a width of approximately twice the maximum coin diameter, and is spanned across a pair of rollers, and is provided slightly with a rising tilt.

This deposit flat belt 122 is movable by the electric motor 126 in a normal rotation direction to transfer the coins forward and in a reverse rotation direction to return the coins. The break-up roller 124 is disposed above an intermediate portion of the deposit flat belt 122 at a spacing of approximately three times the thinnest coins with the flat belt 122.

The break-up roller 124 is configured to have its undersurface rotated in a direction reverse to the advancing direction of the deposit flat belt 122 when the deposit flat belt advances in the transfer direction, and is put into a rest state when the deposit flat belt 122 moves in the returning direction.

However, when the deposit flat belt 122 moves in a returning direction, the undersurface of the break-up roller 124 may be rotated so as to return to the same direction. As a result, when the thinnest coins are superposed more than three pieces on the flat belt 122 and arrive at the break-up roller 124, the top most coin is moved to the returning direction and is dropped by the break-up roller 124, so that a large number of coins will not drop onto the separate feeding device 104 at one time.

A photoelectric sensor is disposed such that its optical axis intersects slightly above the deposit flat belt 122 below the input port 120, thereby configuring a deposit detection device 128. When the optical axis of the deposit detection device 128 is blocked, coins are assumed to be inputted, and the motor 126 is activated so that the deposit flat belt 122 is moved in a deposit direction.

Further, when a full coin sensor 136 to be described later of the separate feeding device 104 detects a full state in a storage area, the motor 126 is stopped. Consequently, the separate feeding device 104 will not receive coins which exceed a full storage amount from the deposit device 102, and can stably separate and feed out the coins one by one. The deposit detection device 128 can be changed to or combined with a magnetic sensor disposed below the deposit flat belt 122.

Next, the separate feeding device 104 will be described.

Figure 3:
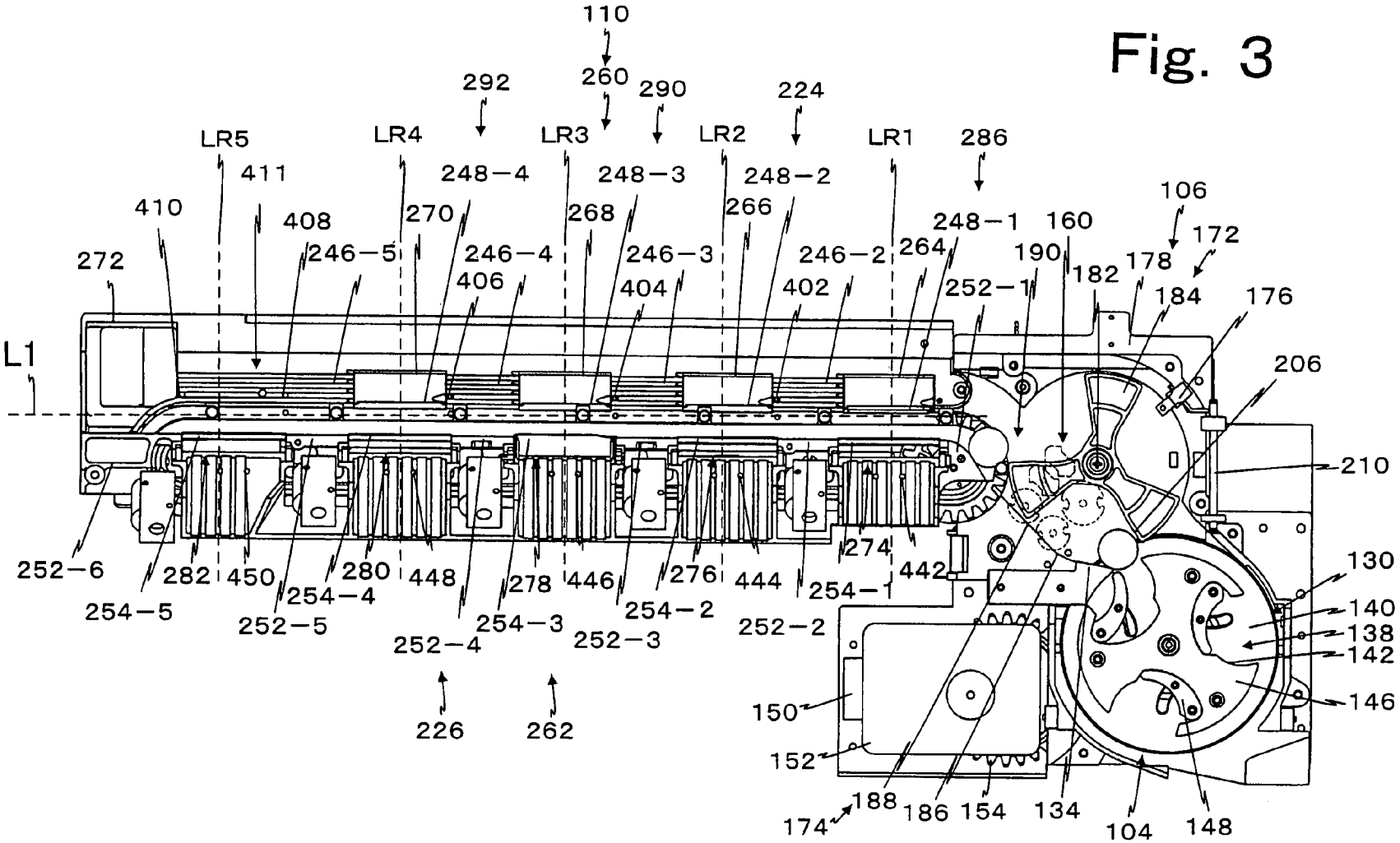
FIG. 3 is a partial front view of a separate feeding device of the coin deposit payment machine, the denomination discriminating device, and the denomination discriminating device.
Figure 4:
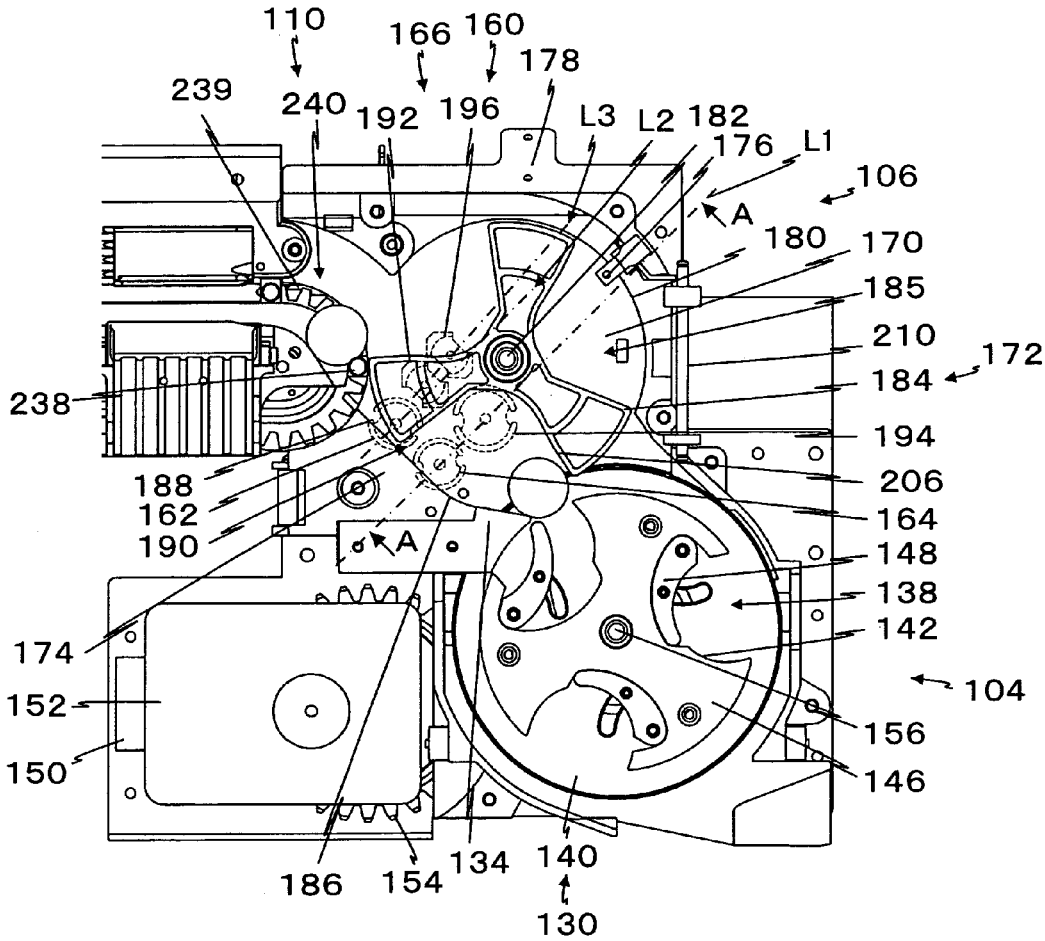
FIG. 4 is a partial front view of the separate feeding device of the coin deposit payment machine and the denomination discriminating device.

The separate feeding device 104 has the functions of separating the coins of multiple denominations received in a bulk-load state from the deposit device 102 feeding them to the next process in a sequential one by one mode. The separate feeding device 104 is disposed below the deposit device 102, and as shown in FIGS. 2 to 4, includes a rotating disk 130, a storing bowl 132, an accommodating body 134, and the full coin sensor 136.

The rotating disk 130 includes a accommodating portion 138 for accommodating the coins one by one from the storing bowl 132, and is inclinedly disposed at a predetermined angle to a vertical plane, and is rotated at a predetermined speed. This accommodating portion 138 fixes a Y-shaped plate 146, which forms three concave portions 142 at equal spacing, coaxially arranged on an upper surface of a rotating circular base plate 140. The thickness of the plate 146 is made slightly thinner than the thickness of the thinnest coin, and if another coin rides on the thinnest coin, and it will not be pushed forcibly by the plate 146. When the diameter of the circular plate 140 is made large, the number of coin accommodating portions 138 can be increased to four or more, and when the diameter of the circular plate 140 is made smaller, the number of accommodating portion 138 can be decreased to two or less than that.

However, since making the diameter of the circular disk 140 large would lead to a large structural size of the coin deposit payment device 100, this is not preferable, and when the number of accommodating portion 138 is decreased below three, the number of feeding coins per unit hour is decreased, and this requires taking extra time for the deposit processing of the coins, and therefore, it is most favorable that the number of accommodating portion 138 is three to provide the desired compact sizes. Further, a movable push-out body 148 which performs a pivot movement is disposed at one side of a concave portion 142. In other words, an approximately semi-circular coin accommodating portion 138 is formed by the combination of the push-out body 148 and the concave portion 142 on the rotary rotating disk 130.

The coin accommodating portion 138 is unable to accommodate the thinnest diameter coins when lined up in two pieces, and is set to a size capable of accommodating only one piece of the maximum diameter coin. The push-out body 148 is usually positioned in a rest state at a position shifted to a radially inward side of the concave portion 142 so as to form the coin accommodating portion 138, and when moved to a predetermined radially outward position by performing the pivot movement, can feed out any held coin in a peripheral direction of the circular plate 140. The movement of this push-out body 148 is preferably performed by using a groove cam and follows by utilizing the rotational movement of the circular plate 140 to force the follower to track the groove cam.

The coin accommodating portion 138 of the rotating plate 130 accommodates the coins one by one, which are held in a bulk-load state at a lower portion facing a the storing bowl 132. The push-out body 148 pushes out the coins of the accommodating portion 138 in a peripheral direction at the predetermined position above a rotational center, and deliver them to a knife shaped accommodating body 134 for coin separation.

Figure 6:
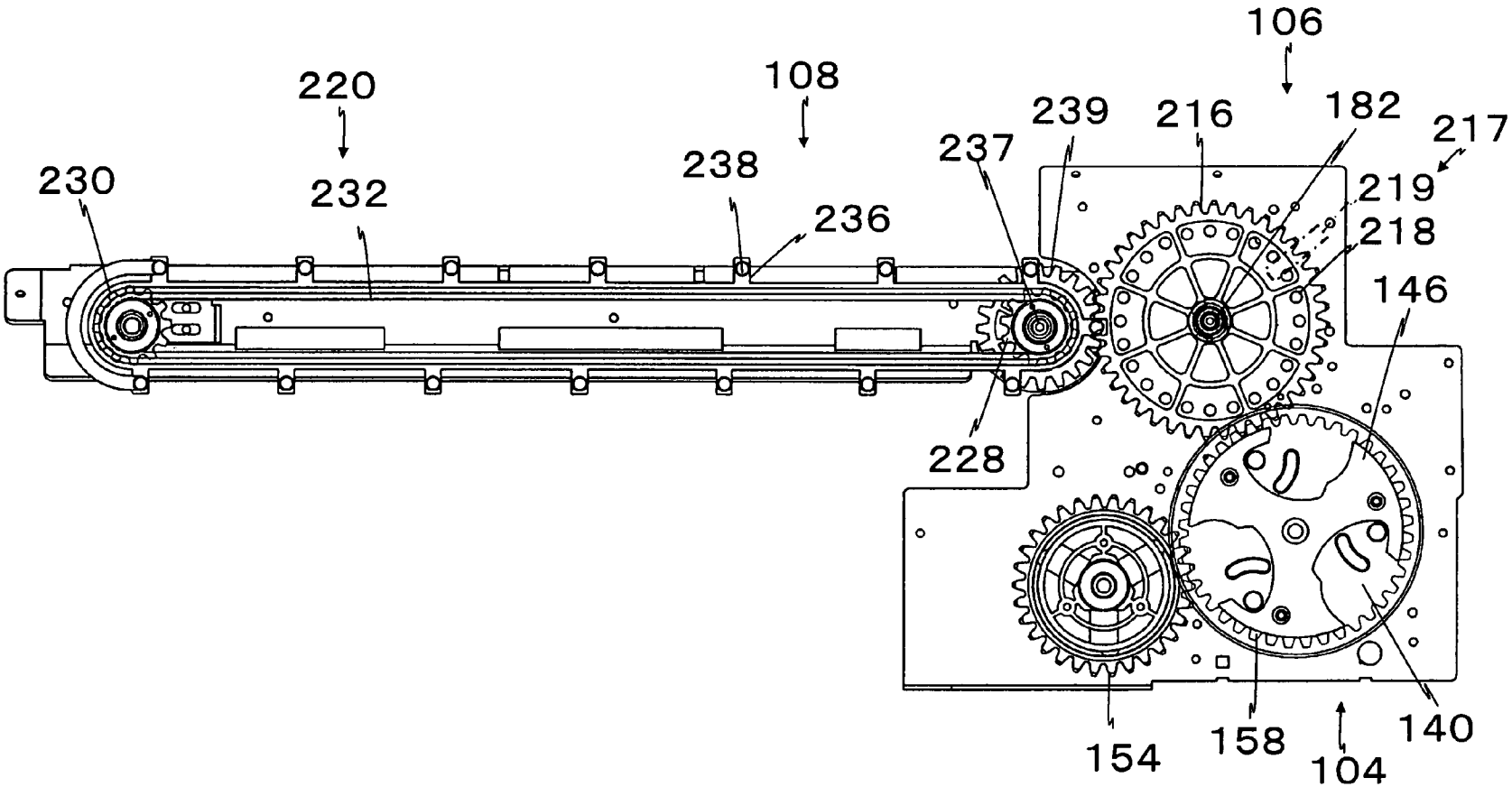
FIG. 6 is a drive system diagram of the separate feeding device of the coin deposit payment machine, the denomination discriminating device, and the denomination discriminating device.

As shown in FIGS. 4 and 6, the rotating plate or disk 130 is rotated at a predetermined speed through a driven gear 158 formed at a bottom peripheral surface of the rotating circular plate 140 by a gear 154 rotated trough a speed reducer 152 by an electric motor 150 disposed at a lateral side.

The full coin sensor 136 has the functions of outputting a full signal when the coin amount in the storing bowl 132 exceeds a predetermined amount, and for example, it can be a photoelectric sensor of a transmission type although other types of sensors can be used.

When the coin amount in the storing bowl 132 is equal to or more than a predetermined amount, an agitating efficiency of the coins by the Y-shaped plate 146 and the push-out body 148 is reduced, and therefore, the full coin sensor 136 eliminates any trouble in processing coins into the accommodating portion 138. When the full coin sensor 136 outputs a full signal, the electric motor 126 is stopped, and the supply of coins from the deposit device 102 is stopped. When the full sensor 136 does not output a full coin signal, the electric motor 126 is started again, and the coins on the deposit flat belt 122 are supplied to the storing bowl 132.

Next, the coin denomination discriminating device 106 will be described with reference to FIGS. 4 and 5. The denomination discriminating device 106 has the functions of discriminating the authenticity and denominations of the coins fed out one by one from the separate feeding device 104.

The denomination discriminating device 106 also has the functions of discriminating the authenticity and denominations of the coins based on detection data obtained from a magnetic sensor unit 160. Specifically, the denomination discriminating device 106 has the functions of discriminating the authenticity and denomination of the coins based on detection data from a material quality sensor, thickness sensor, and the diameter sensor of the coin obtained from the magnetic sensor unit 160. The denomination discriminating device 106 can perform the discrimination of the authenticity and denomination of the coins by using the material quality sensor, the thickness sensor, and the diameter sensor which can be configured by one or more coils and predetermined ferrite cores.

The denomination discriminating device 106 includes the magnetic sensor 160, a slide base 170 disposed in the same flat surface as the upper surface of the rotating circular plate 140, and a rotating body 172 for feeding the coins, and a reference guide 174.

First, the slide base 170 shown in FIG. 5 will be described.

The slide base 170 has the functions of guiding one surface of the coin inclinedly disposed on the upper surface of a base 178 and push-moved by the rotating body 172.

The slide base 170 is a bottom surface of a circular hole 180 formed on the upper surface of a flat-plate shaped base 178 formed by a non-magnetic material, for example, resin, and its surface has a flat-surface shape.

However, the slide base 170 is provided with a convex stripe extending in the moving direction of the coin, so that any sliding resistance of the coin can be reduced.

Next, the rotating body 172 will be described.

The rotating body 172 has the functions of moving the coins received from the separate feeding device 104 and allowing them to pass through the magnetic sensor portion 160 one by one. The rotating body 172 delivers a coin having passed by the magnetic sensor 160 to the transferring device 108. The rotating body 172 is preferably shaped by a non-magnetic material, for example, resin, and is fixed to an axis of rotation 182 protruded to a center portion of the circular hole 180, and is parallel with the slide base 170, and moreover, is rotatable in an adjacent flat surface. The rotating body 172 forms a plurality of coin accommodating portions 185 by three pieces of push-to-move levers 184 disposed at equal intervals of the same number of pieces as the accommodating portions 138, and forms a Y-shape.

Next, the reference guide 174 will be described.

The reference guide 174 has the functions of linearly guiding the coin passing through to face the magnetic sensor 160, and making the sensory positions of the classified denomination coins for the magnetic sensor 160 constant. The reference guide 174 has an arched portion 186 formed following the accommodating body 134 and a straight-line guide portion 188 formed following the arched portion 186, and is positioned at the outer periphery of the rotating route of the rotating body 172, and guides the coin push-moved by the push-to-move lever 184. The reference guide 174 is preferably formed of a polyoxymethylene which is an excellent resin in abrasion resistance in order to guide the coins. Further, the reference guide 174 can be integrally shaped with the slide base 170 in order to improve manufacturing efficiency and accuracy.

Next, the magnetic sensor 160 will be described with reference to FIGS. 4 and 5.

The magnetic sensor 160 has the functions of obtaining a data for discriminating the authenticity and denomination of the coin guided by the reference guide 174. The magnetic sensors 160 are disposed above and below a movement route 190 of the coin moved by the push-to-move lever 184, while being guided by the reference guide 174. The magnetic sensor 160 includes a diameter sensor 166, a thickness sensor 164, and a material quality sensor 162. The diameter sensor 166 has the functions of obtaining a data regarding the diameter of the coin moved by the rotating body 172.

Euro coins have eight types of denominations, and since a 2 Euro coin of the maximum diameter is approximately twice a 1 Euro coin of the minimum diameter, it is difficult to obtain a highly accurate data only by one diameter sensor. Hence, the present embodiment is configured by a plurality of diameter sensors. Specifically, the present embodiment is configured by a first diameter sensor 192, a second diameter sensor 194, and a third diameter sensor 196.

Figure 5:
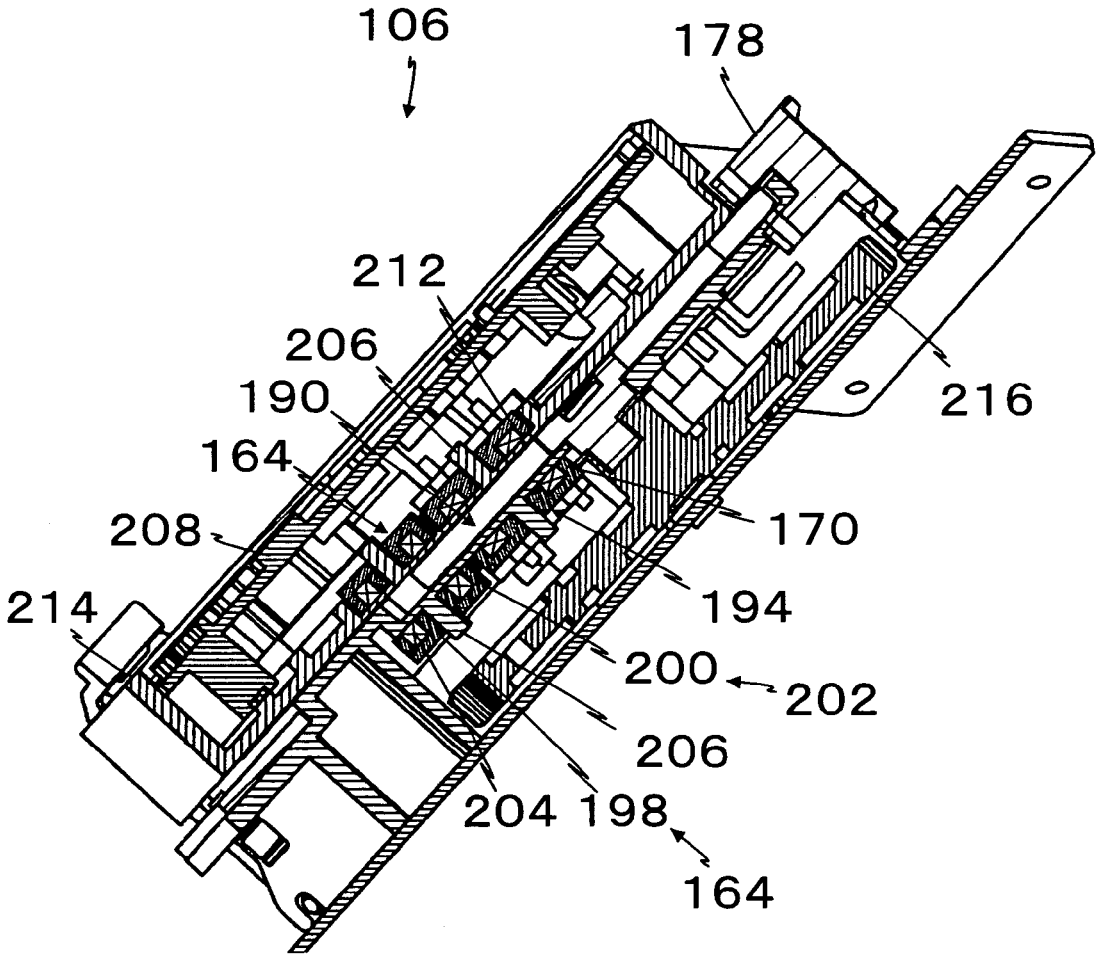
FIG. 5 is a sectional view cut along the line A-A in FIG. 4.

As shown in FIGS. 4 and 5, the material quality sensor 162, the thickness sensor 164, and the second diameter sensor 194 is a magnetic sensor configured by winding a coil 204 around a central cylinder 198 of a core 202 including a cylindrical central cylinder 198 and a ferrite having an approximately cylindrical external wall 200 surrounding the periphery. Since the magnetic sensor can be configured by a coil, a core, and an impressing circuit of high frequency or the like, procurement availability is excellent, and-the price is moderate in spite of the fact that highly accurate data can be obtained, and thus, it is suitable for a coin denomination discriminating device.

As shown in FIG. 4, the first diameter sensor 192 and the third diameter sensor 196 have an external wall eliminated from an external wall 200 of the portion facing the cylindrical center cylinder 198 and the straight-line guide portion 188, and is formed approximately in the shape of a rectangle. By being formed in the shape of a rectangle in this manner, it is possible to adjacently dispose the first diameter sensor 192 and the third diameter sensor 196, and data for performing a highly accurate diameter discrimination can be obtained.

Each of the sensors 162, 164, 192, 194, and 196 is fitted to a column-shaped positioning pin 206 allowing a hole of central cylinder 198 to protrude from the rear surface of the slide base 170, and is fixed by a bonding agent and the like. By the use of a positioning pin 206 and the hole of the center cylinder 198, the position of each of the magnetic sensors 162, 164, 192, 194, and 196 is decided, and therefore, there is an advantage that the position of the magnetic sensors are easily and accurately positioned.

The thickness sensor 164 and the second diameter sensor 194 are disposed adjacent to the accommodating body 134, and are disposed on a first straight line L1 orthogonal to the straight-line guide portion 188. The thickness sensor 164 is disposed adjacent to the reference guide 174, and the end surface of the center cylinder 198 faces the coin surfaces of all denominations.

The second diameter sensor 194 is disposed so as to face with an approximately one quarter of the maximum diameter 2 Euro coin, and moreover, is disposed at a position to face with an approximately entire surface of the maximum diameter coin that can be discriminated.

The material quality sensor 162 is disposed at the down stream side of the straight line L1 and on the line L2 approximately orthogonal to the straight-line guide portion 188.

The first diameter sensor 192 and the third diameter sensor 196 are located immediately at the downstream of the second straight line L2, and moreover, on a third straight line L3 approximately orthogonal to the straight-line guide portion 188.

An elongation of the push-out portion 206 of the coin of the push-to-move lever 184 of the rotating body 172 is set to cross at a sharp angle until the maximum diameter portion of the coin faces with the material quality sensor 162, the first diameter sensor 192, and the third diameter sensor 196, and is set to receive a component force by which the coin pushed by the push-out portion 206 is pushed to the straight-line guide portion 188. This is because the coin is always guided by contacting the straight-line guide portion 188, thereby enhancing the accuracy of the diameter detection.

The material quality sensor 162 is disposed immediately adjacent to the reference guide 174, and the end surface of the center cylinder 198 faces the surfaces of the coins of all denominations.

The first diameter sensor 192 is disposed so as to slightly face the upper portion of the 1 cent coin of the smallest diameter guided by the straight-line guide portion 188. The third diameter sensor 196, when faced with the 2 Euro coin of the maximum diameter, is disposed such that the lower half of the magnetic sensor 196 faces the upper end portion of the 2 Euro coin.

The thickness sensor 164, the material quality sensor 162, the first diameter sensor 192, the second diameter sensor 194, and the third diameter sensor 196 are configured by a pair of magnetic sensors disposed above and below the movement route 190 of each coin. One of a pair of magnetic sensors is fixed to the rear surface of the slide base 170, and the other is fixed to an upper cover 208.

Next, the upper cover 208 will be described.

The upper cover 208 is above the separate feeding device 104, and is pivotally-movably attached to an axis 210 disposed at the lateral side of the circular hole 180. The upper cover 208 takes on an approximately trapezoid shape when seen flat, and a lower surface 212 is flat, and a part thereof is positioned by facially contacting the upper surface of the reference guide 174. In other words, by a facial contact between the under surface 212 of the upper cover 208 and the upper surface of the reference guide 174 a gap between the slider base 170 and the under surface 212 is kept small and in parallel.

The gap between the slide base 170 and the under surface 212 is set by adding an allowance to the maximum thickness of the operating coin. The upper cover 208 is fixed by a hook (not shown) in a state of the facial contact with the upper surface of the reference guide 174. Consequently, in the denomination discriminating device 106, the coin is push-moved in a thin movement route 190 defined by the slide base 170, the under surface 212, and the reference guide 174 by the push-to-move lever 184.

The thickness of the push-to-move lever 184 is slightly smaller than the gap between the slide base 170 and the under surface 212, and moreover, is formed slightly thicker than the thickness of the thickest coin. This is for the improvement of strength and abrasion resistance and easiness of production.

As shown in FIG. 6, a push-to move lever gear 216 is fixed to the lower end portion penetrated with the slide lever 170 of the axis of rotation 182, and engages with a driven gear 158 integrally formed with the rotating plate 140. A gear ratio of the driven gear 158 to the push-to-move lever gear 216 is 1:1, and immediately after the push-out body 148 pushes out the coin toward the outside of the accommodating portion 138 and delivers it to the accommodating body 134, a timing is set such that the push-too-move lever 184 push-moves the received coin.

Next, the first timing sensor 176 will be described.

A signal outputted every time the push-to move lever 184 passes through from the timing sensor 176 is used as an associated signal for storing discriminating information on the authenticity and denomination of the coin discriminated based on the data detected by the magnetic sensor 160. The timing sensor 176 is fixed to a base 178. In the present embodiment, the timing sensor 176 is a photoelectric sensor of a reflecting type, and when facing the push-to-move lever 184, outputs a push-to-move lever timing signal of "H", and when not facing, outputs a signal of "L."

Next, the second timing sensor 217 will be described.

The second timing sensor 217 has the functions of outputting a timing signal for each predetermined rotational angle smaller than the first timing sensor 176 when the rotating body 172 is rotated. In the present embodiment, a light-projecting element is disposed below a gear 216 and a through-hole 218 bored for each predetermined angle on the same circle with the axis of rotation as a center, and is configured by the photoelectric sensor 219 of a transmission type disposed with a light-receiving element on the upper side of the gear 216. The through-hole 218 is, for example, bored 24 pieces at equal intervals.

Consequently, when the projected light from the light projecting element transmits the through-hole 218 and enters the light-receiving element, the second timing sensor 217 outputs a second timing signal of "H", and when the projected light from the light projecting element is shut out by the push-to-move lever gear 216, the second timing sensor 217 outputs a signal of "L." In other words, during one cycle of the first timing sensor 176, eight pieces of the second timing signals are outputted, thereby increasing resolution of the rotating angle of the rotating body 172.

Next, the transferring device 108 will be described.

The transferring device 108 has the functions of transferring a coin of which authenticity and denomination are discriminated to the selecting portion 110. In other words, the transferring device 108 has the functions of push-moving a coin having one surface of the coin supported by a slide plate 224 to be described later and the outer peripheral surface supported by the guide rail 226, and moving them in a predetermined direction. The transferring device 108 includes an endless transferring body 220 moving in one direction within the same flat surface.

In the present embodiment, the endless transferring body 220 is an endless chain 232 spanned across a first sub-sprocket 228 and a second sub-sprocket 230 which are spaced at a predetermined spacing. The chain 232 is disposed in the shape of a flat running track, and the first sprocket 228 is disposed immediately at the lateral side of the rotating body 172 of the coin denomination discriminating device 106. Although the chain 232 is preferably made of metal in view of durability and cost, it can be made of resin. The chain 232 is circularly moved in a predetermined direction within a flat surface inclined approximately 45 degrees for a horizontal line. Push-to-move pins 238 protruding above the direction orthogonal to a plate 236 protruding to the outside from a connecting pin 234 of the chain 232 are fixed at predetermined intervals.

Consequently, the push-to-move pins 238 are circularly moved in the predetermined direction within a flat surface P (see FIG. 8) inclined approximately at 45 degrees to the vertical. The push-to-move pin 238 is plurally attached to the chain 232 at the intervals corresponding to the intervals of the push-to-move levers 184 for receiving the coins.

A driven gear 239 is fixed to the lower portion of an axis 237 to which the first sprocket 228 is fixed, and engages with the push-to-move lever gear 216. The gear ratio of the gear 239 to the gear 216 is 1:3. In other words, the push-to-move lever 184 and the push-to-move pin 238 are interlocked by the predetermined relationship. Specifically, the coin push-moved to the movement route 240 of the push-to-move pin 238 by the push-to-move lever 184 is set to be immediately moved by the push-to-move pin 238.

Consequently, since the coin is transferred by the push-to-move pin 238, the minimum unit of the transferring device 108 is the push-to-move pin 238, and in the present specification, when it comes to the transferring device 108, it is sometimes referred to only as the push-to-move pin 238. The movement route 240 takes on a flat loop form positioned so as to surround the endless transferring body 220, and is positioned slightly above in parallel with an inclined flat surface disposed with the endless transferring body 220.

Next, the slide plate 224 will be described.

Figure 8:
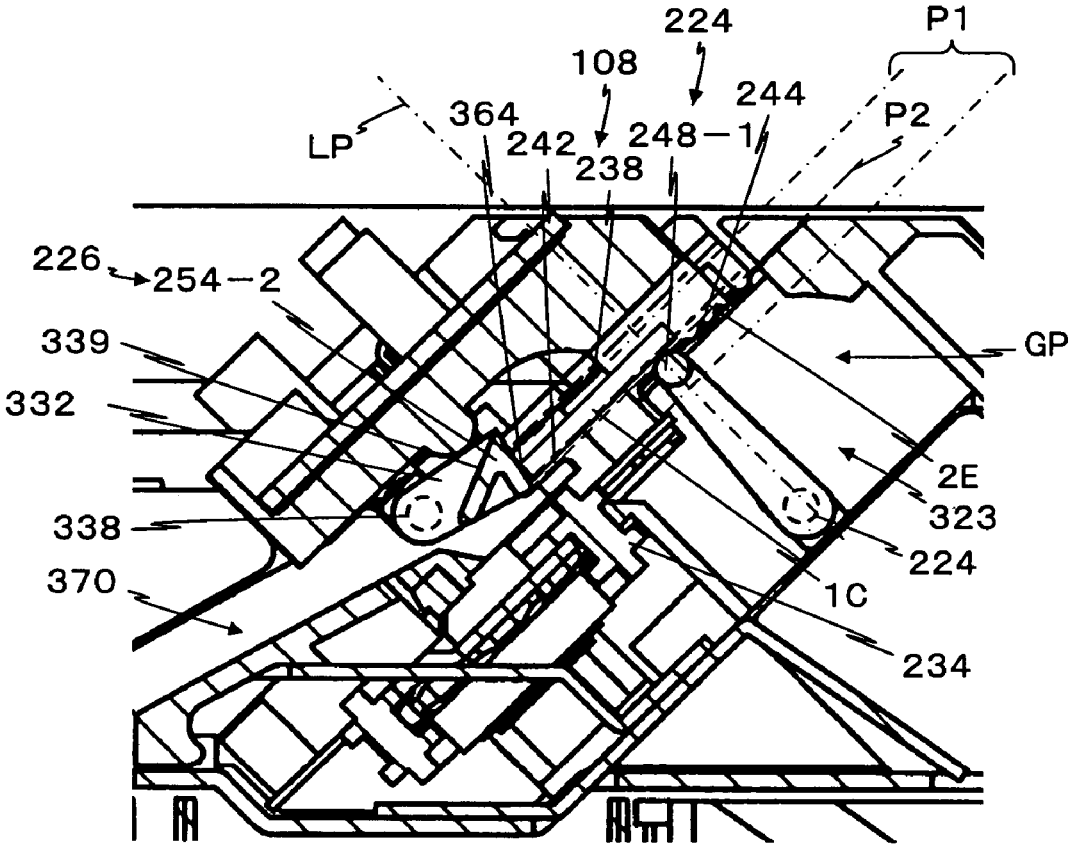
FIG. 8 is a sectional view cut along the line B-B in FIG. 7.

The slide plate 224 has the functions of guiding the under surface of the coin transferred by the transferring device 108. Specifically, a first slide guide 242 is disposed at the lateral side as well as at the lower side of the movement route 240 of the push-to-move pin 238, and the a second slide guide 244 is disposed at the lateral side as well as at the upper side along the movement route 240. As shown in FIG. 8, the first slide guide 242 and the second slide guide 244 are disposed in parallel at a space smaller than the diameter of the smallest diameter 1 cent coin 1C among the coins of the multiple types, and the first slide guide 242 is down below the movement route 240 of the push-to-move pin 238 in the vertical direction, and the second slide guide 244 is disposed above the movement route 240. To describe more in detail, a flat surface P2 connecting the surfaces of the first slide guide 242 and the second slide guide 244 is located within the flat surface P, and is inclined approximately at 45 degrees.

Consequently, the coin transferred by the transferring device 108 has its lower surface supported by the first slide guide 242 and the second slide guide 244, and is transferred, while being inclined approximately 45 degrees from a horizontal plane. To miniaturize the entire coin deposit payment device 100, the above described angle is preferably approximately 45 degrees.

Since the slide plate 224 may only support the coin from the lower side, thin bars juxtaposed at small intervals and made into a plate shape as a whole may have the functions of guiding the coin. In the present embodiment, the slide plate 224 is shaped by resin having abrasion resistance, and a protruded stripe 245 extending in the advancing direction of the coin is formed at the portion sliding with the coin, thereby reducing the advancing resistance of the coin, see FIG. 7.

Next, the first slide guide 242 will be described.

In the present embodiment, the first slide guide 242 is a rectilinear plate having a narrow width, and the upper surface thereof is inclined approximately 45 degrees, and supports the under surfaces of all the coins moved by the push-to-move pin 238.

Figure 9:
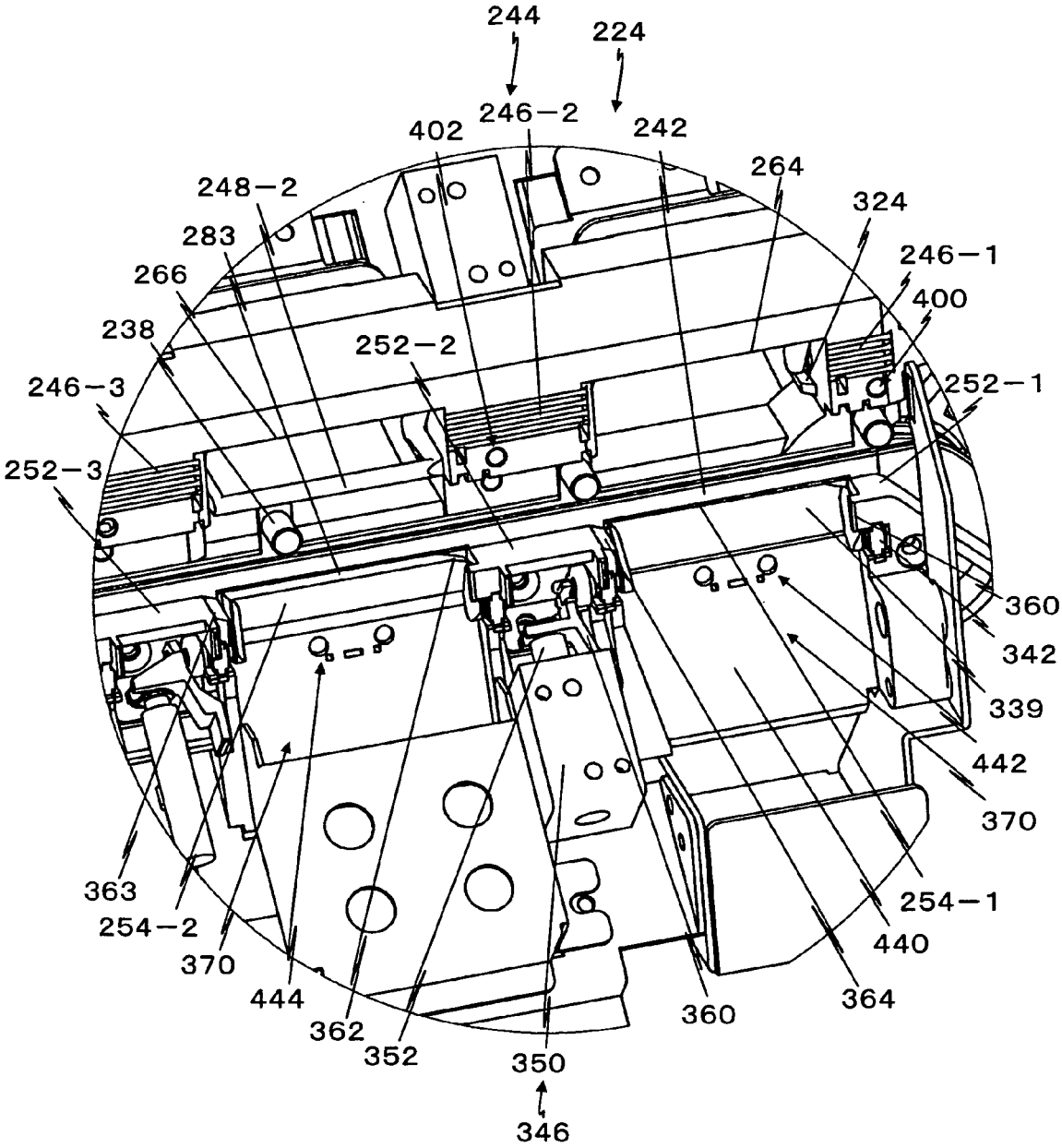
FIG. 9 is a partially enlarged oblique view of a selecting portion of the distribution device for each denomination of the coins.

Next, the second slide guide 244 will be described with reference to FIGS. 8 and 9.

In the present embodiment, the second slide guide 244 is configured by a first fixed guide plate 246-1, a second fixed guide plate 246-2, a third fixed guide plate 246-3, a fourth fixed guide plate 246-4, and a fifth fixed guide plate 246-5, which are disposed at predetermined intervals in a fixed state in order from the denomination discriminating device 106 side, and a first movable guide plate 248-1, a second movable guide plate 248-2, a third movable guide plate 248-3 and a fourth movable guide plate 248-4, which are disposed among those fixed guide plates.

When each of the movable guide plates 248-1, 248-2, 248-3, and 248-4 are at a guide position GP, they are in range with each of the guide plates 246-1, 246-2, 246-3, 246-4, and 246-5, and are positioned at intervals smaller than the diameter of the minimum diameter 1 cent coin for the guide rail 226, and therefore, support and guide the under surfaces of all the coins moved by the push-to-move pin 238. The movable guide plates 248-1, 248-2, 248-3, and 248-4 also configure a first selecting portion 260 as to be described later.

Next, the guide rail 226 will be described.

The guide rail 226 has the function of guiding the lower side peripheral surface of the coin transferred by the transferring device 108. In the present embodiment, the guide rail 226 makes approximately right angle with the slide plate 224, specifically the first slide guide 242, and is below the movement route 240, and extends approximately in parallel with the 240 in a state of being adjacent to the upper surface of the first slide guide 242. To describe more in detail, the guide rail 226 is positioned approximately within a flat surface P1, and has a thickness slightly larger than the thickness of the maximum coin, see FIG. 8. In other words, the guide rail 226 protrudes in a direction slightly orthogonal to the maximum thickness of the operating coin from the upper surface of the first slide guide 242. Consequently, a coin pushed by the push-to-move pin 238 has its lower surface guided by slide plate 224, and the lower end peripheral surface thereof is guided by the guide rail 226.

The guide rail 226 is configured by a first fixed guide rails 252-1, second fixed guide rail 252-2, a third fixed guide rail 252-3, a fourth fixed guide rail 252-4, a fifth fixed guide rail 252-5, and a sixth guide rail 252-6, which are disposed at predetermine intervals in a fixed state, and a first movable guide rail 254-1, a second movable guide rail 254-2, a third movable guide rail 254-3, a fourth movable guide rail 254-4, and a fifth movable guide rail 254-5, which are disposed among each fixed guide rail, see FIG. 3. The first movable guide rail 254-1, the second movable guide rail 254-2, the third movable guide 254-3, the fourth movable guide 254-4, and the fifth movable guide 254-5 also configure a second selecting portion 262 to be described later.

Next, the selecting portion 110 will be described with reference to FIG. 3.

The selecting portion 110 has the functions of selecting a coin moved by the transferring device 108 into a predetermined selecting portion for each denomination. The selecting portion 110 includes the first selecting portion 260 disposed at the upper side of the movement route 240 and along the movement route 240, and the second selecting portion 262 disposed at the lower side and along the guide rail 226 below the movement passage 240.

The first selecting portion 260 is disposed with a 2 cent selection port 264, a 5 cent selection port 266, a 10 cent selecting port 268, a 20 cent selecting port 270, and an overflow selecting portion 272 in order from the upper stream of the advancing direction toward the downstream of the transferring device 108. The second selecting port 262 is disposed with a reject selecting port 274, a 1 cent selecting port 276, a 2 Euro selecting port 278, a 50 cent selecting port 280, and a 1 Euro selecting port 282 in order from the upper stream of the advancing direction toward the downstream of the transferring device 108.

The 2 cent selecting port 264 is defined between the first fixed guide plate 246-1 and the second fixed guide plate 246-2 which are disposed at the predetermined intervals, and the 5 cent selecting port is defined between the second fixed guide plate 246-2 and the third fixed guide plate 246-4, and the 10 cent selecting port 268 is defined between the third fixed guide plate 246-3 and the fourth fixed guide plate 264-4, and the 20 cent selecting port 270 is defined between the fourth fixed guide plate 2644 and the fifth fixed guide plate 246-5.

The reject selecting port 274 is defined between the first fixed guide rail 252-1 and the second fixed guide rail 252-2 which are disposed at the predetermined intervals, and the 1 cent selecting port 276 is defined between the second fixed guide rail 252-2 and the third fixed guide rail 252-3 which are disposed at the predetermined intervals, and the 2 Euro selecting port 278 is defined between the third fixed guide rail 252-3 and the fourth fixed guide rail 252-4, and the 50 cent selecting portion 280 is defined between the fourth fixed guide rail 252-4 and the fifth fixed guide rail 252-5, and the 1 Euro selecting portion 282 is defined between the fifth fixed guide rail 252-5 and the sixth fixed guide rail 252-6.

The predetermined intervals of each of the fixed guide plates 246-2, 246-3, 246-4 and 246-5, and each of the fixed guide rails 252-1, 252-2, 252-3, 252-4, 252-5, and 252-6 are preferably approximately 1.5 times or more the maximum diameter of the coin used in order to surely drop off the coin moving at a predetermined speed, though relating also to the transferring speed of the coin.

Each of the selecting ports 264, 266, 268, 270, 272, 274, 276, 278, and 280 is disposed with a gate electrically controlled in order to select a coin of a predetermined denomination.

The first movable guide plate 248-1 is a gate 286 for the 2 cent, the second movable guide plate 248-2 is a gate 288 for the 5 cent, the third movable guide plate 248-3 is a gate 290 for the 10 cent, and the fourth movable guide plate 248-4 is a gate 292 for the 20 cent. In other words, the 2 cent selecting portion 264 of the first selecting portion 260 is disposed with the first movable guide plate 248-1, and the 5 cent selecting port 266 is disposed with the second movable guide plate 248-2, and the 10 cent selecting port 268 is disposed with the movable guide plate 248-3, and the 20 cent selecting port 270 is disposed with the fourth movable guide plate 248-4.

When the first movable guide plate 248-1, the second movable guide plate 248-2, the third movable guide plate 248-3, and the fourth movable guide plate 248-4 are positioned at a guide position GP, these plates are disposed at a predetermined distance from the guide rail 226, specifically at a position smaller than the diameter of the minimum diameter 1 cent coin and separated from the center of gravity of the 2 Euro coin which is the maximum diameter coin.

Figure 10:
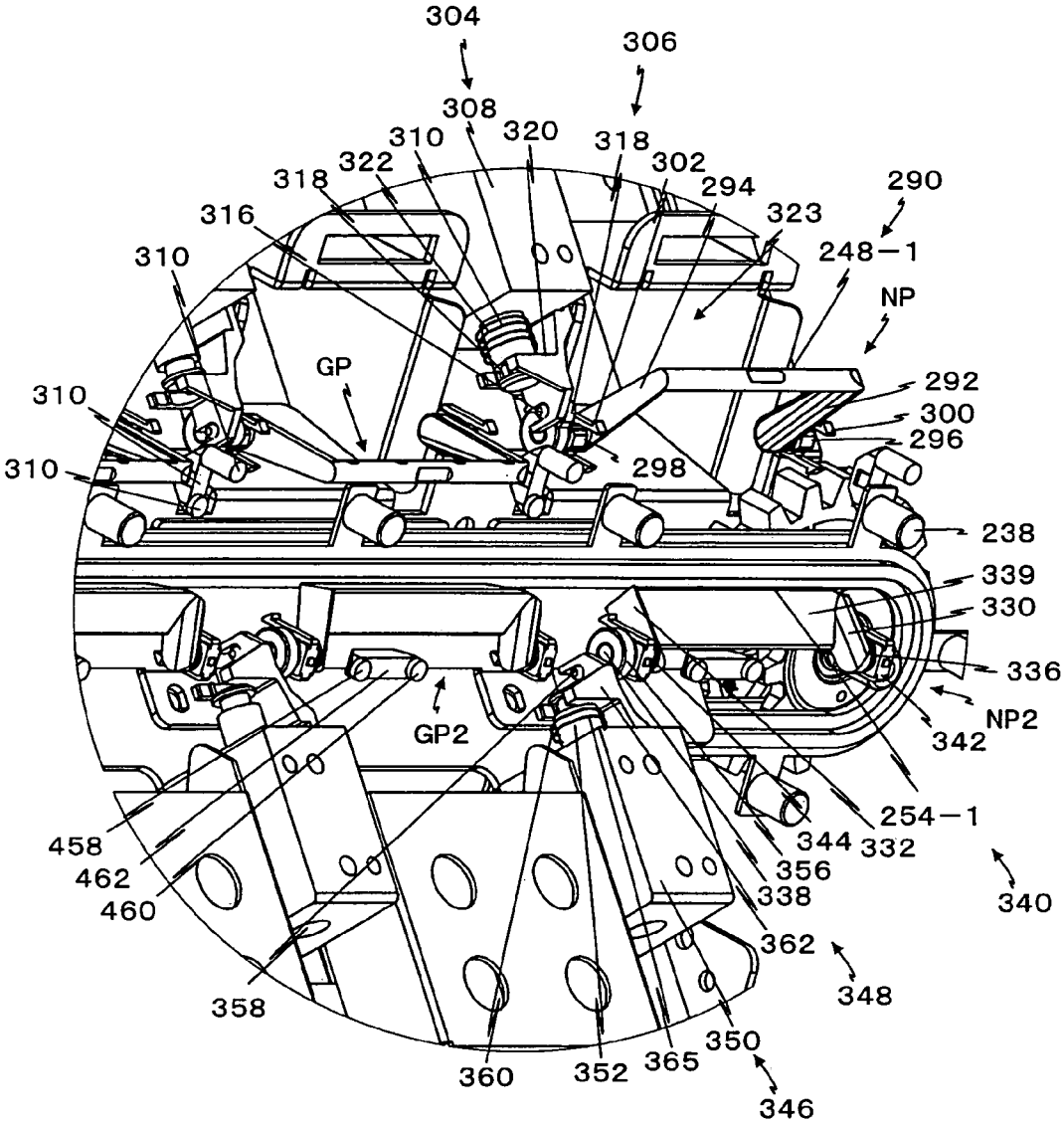
FIG. 10 is a partially enlarged oblique view of the selecting portion deleting a part of parts of the distribution device for each denomination of the coins.

Consequently, when each of the movable guide plates 248-1, 248-2, 248-3, and 248-4 is positioned at the guide position GP, shown in FIG. 8 and FIG. 10. The coin pushed by the push-to-move pin 238 and moving while being guided by the guide rail 226 is supported in the lower end portion of the lower surface by the first slide guide 242, and is supported in the upper portion of the lower surface by these movable guide plates 248-1, 248-2, 248-3, and 248-4, and therefore, the coin will not drop into the selecting ports 284, 286, 288, and 290 of the first selecting port 260.

These guide plates 248-1, 248-2, 248-3, and 248-4 are preferably column-shaped. This is because a contact between the movable guide plates 248-1, 248-2, 248-3, and 248-4 and the under surface of the coin is a line contact, and even when the movable guide plates 248-1, 248-2, 248-3, and 248-4 move, the contact with the under surface of the coin can be kept as the line contact, thereby reducing the slide resistance of the coin to the minimum.

The reject selecting port 274 of the second selecting portion 262 is disposed with the first movable guide rail 254-1, and the 1 cent selecting portion 276 is disposed with the second movable guide rail 254-2, and the 2 Euro selecting portion 278 is disposed with the third movable guide rail 254-3, and the 50 cent selecting portion 280 is disposed with the fourth movable guide rail 254-4, and the 1 Euro selecting portion 282 is disposed with the fifth movable guide rail 254-5. When the first movable guide rail 254-1, the second movable guide rail 254-2, the third movable guide rail 254-3, the fourth movable guide rail 254-4 and the fifth movable guide rail 254-5 are positioned at the guide position GP, guide surfaces 283 which are the upper surfaces of these guide rails are practically in range with the first fixed guide rail 252-1, the second fixed guide rail 252-2, the third fixed guide rail 252-3, the fourth fixed guide rail 252-4, the fifth fixed guide rail 252-5, and the sixth fixed guide rail 252-6.

Further, the 2 cent selecting port 264 is disposed at the upper side of the movement route 240 along a line LR1 orthogonal to a center line L1 in the movement route 240 at a first predetermined distance from the denomination discriminating device 106, and the reject selecting portion 274 is disposed at the lower side of the movement route 240.

At a second predetermined distance further away than the first predetermined distance from the denomination discriminating device 106, along a line LR2 orthogonal to the center line L1, the 5 cent selecting port 266 is disposed at the upper side of the movement route 240, and the 1 cent selecting port 276 is disposed at the lower side thereof. At a third predetermined distance further away than the second predetermined distance from the denomination discriminating device 106, along a line LR3 orthogonal to the center line L1, the 10 cent selecting port 268 is disposed at the upper side of the movement route 240, and the 2 Euro selecting port 278 is disposed at the lower side thereof.

At a fourth predetermined distance further away than the third predetermined distance from the denomination discriminating device 106, along a line LR4 orthogonal to the center line L1, the 20 cent selecting port 270 is disposed at the upper side of the movement route 240, and the 50 cent selecting port 282 is disposed at the lower side thereof. At a fifth predetermined distance further away than the fourth predetermined distance from the denomination discriminating device 106, along a line LR5 orthogonal to the center line L1, the 2 Euro selecting port 282 is disposed at the lower side of the movement route 240. At a sixth predetermined distance further away than the fifth predetermined distance from the denomination discriminating device 106, the overflow selecting port 272 is disposed at the upper side of the movement route 240.

From the first predetermined distance to the fourth predetermined distance are associated with the intervals of the push-to-move lever 184, and specifically, they are set to the same intervals as the intervals of the push-to-move pin 238.

Next, the movable guide plates 248-1, 248-2, 248-3, and 248-4 which are the gates of the 2 cent selection port 264, the 5 cent selecting port 266, the 10 cent selecting port 268, and the 20 cent selecting port 270 of the first selecting portion 260 will be described. The movable guide plates 248-1, 248-2, 248-3, and 248-4 can be moved to the guide position GP selectively moving the coin or a non-guide position NP not guiding. Further, since the movable plate guides 248-1, 248-2, 248-3, and 248-4 are of the same structure, a description will be made by adopting the movable guide plates 248-1 and 248-2 as a representative.

The movable guide plate 248-1 includes bars 292 and 294 extending in a right angle direction from both ends thereof, and axes 296 and 298 protruding to the lateral side from the lower end of the bars 292 and 294, and is positioned on the upper end of a gate body 290 of a portal shape as a whole, and is round-bar shaped as described above. The axes 296 and 298 are pivotally supported by fixed axles 300 and 302. The movable guide plate 248-1 is moved to the guide position GP and the non-guide position NP by an actuator 304 trough a linkage 306.

However, the movable guide plate 248-1 can be directly moved by the actuator 304. The actuator 304, in the present embodiment, can be an electromagnetic actuator made from a solenoid 308 and an iron core 310.

The electromagnetic actuator 304 is high in the degree of freedom if wiring is a consideration, and is compact in size and large in output, which is preferable.

Next, the linkage 306 will be described. The linkage 306 includes a clamp pin 316 fixed in parallel with the axis 298 to one end portion of the crank 314 which extends in the peripheral direction from the axis 298 and a spring 322 fixed to the top end of the iron core 310, and impelling the lever 320 and the iron core 310 accommodating the clamp pin 316 into a grove 318 of the top end portion to protrude. According to this configuration, when the solenoid 308 is not excited, the iron core 310 is impelled to protrude by the spring 322, and therefore, the clamp pin 316 is pivotally moved clockwise with the axes 296 and 298 as a center by the lever 320 in FIGS. 8, 9 and 11.

A bar 292 of a gate body 290 is blocked in advancing by a first stopper 324 which protrudes to the side wall of the selecting port 264, and comes to rest, and is held at the guide position GP. As shown in FIG. 8, when the movable guide plate 248-1 is positioned at the guide position GP, the minimum diameter 1 cent coin 1C guided by the guide plate 226 has the upper end portion of the under surface guided by the movable guide plate 248-1, and the push-to-move pin 238 pushes slightly the upper side than the center portion of the coin.

Consequently, when a coin of a small diameter and light weight is used, the coin is pushed out from an upward circular arc by the push-to-move pin 238, and therefore, the coin is applied with a downward force, in other words, a component force pushed by the guide plate 226, and the coin is transferred without jumping from the guide rail 226. Although a coin of the large diameter is moved so as to be pushed from below the circular arc by the push-to-move pin 238, since it is of a large diameter, it is heavy and does not jump up, and is further moved along the guide rail 226.

When the movable guide plate 248-1 is positioned at the non-guide position NP, in the 2 cent selecting portion 264, the 2 cent coin has the under surface of the top end portion not guided by the movable guide plate 248-1. Consequently, the 2 cent coin drops below from the upper end portion, and is guided to a coin storage and payment device for 2 cent to be described later by a guide passage 323, see FIG. 10.

Next, the first movable guide rail 254-1, the second movable guide rail 254-2, the third movable guide rail 254-3, the fourth movable guide rail 254-4, and the fifth movable guide rail 254-5 will be described. Since these movable guide rails are of the same structure, a description will be made by adopting the first movable guide rail 254-1 and the second movable guide rail 254-2 as the representatives.

The first movable guide rail 254-1 includes bars 330 and 332 extending in a right angle direction from both ends thereof, and axes 336 and 338 protruding to the lateral side from the lower end of the bars 330 and 332, and is positioned on the upper end of a second gate body 340 having a portal shape as a whole, and has a narrow width flat-plate shape as described above. The second movable guide rail 254-2, as shown in FIG. 8, makes a slightly sharp angle to the upper surface of the first slide guide 242. This is because, by disposing the second movable guide rail 254-2 so as to make a slightly sharp angle to the upper surface of the first slide guide 242, the guided coin is given a component force pushing to the slide plate 224, so that the coin does not drop from the movable guide rail 254-1.

Further, a dropping guide surface 339 moving downward from the first movable guide rail 254-1 is formed. This is because, the coin which is not guided by the first movable guide rail 254-1 but drops is guided, and is surely guided to the storing portion 112. The axes 336 and 338 are pivot-movably supported by anchor bearings 342 and 344.

The second gate body 340 is disposed along a straight line LR1 making a right angle at the guide rail 226. The movable guide rail 254-1 is moved to the guide position GP2 and the non-guide position NP2 by an actuator 346 through a linkage 348. However, the movable guide rail 254-1 can be directly moved by the actuator 346.

The actuator 346, in the present embodiment, is an electromagnetic type actuator 354 including a solenoid 350 and an iron core 352. The electromagnetic actuator 354 is high in the degree of freedom if a wiring is considered, and is compact in size and large in output, which is preferable.

Next, the linkage 348 will be described. The linkage 348 has the functions of transmitting the movement of the actuator 346 to the movable guide rail 254-1. The linkage 348 includes a clamp pin 358 fixed in parallel with the axis 338 to one end portion of a crank 356 which extends in the peripheral direction from the axis 338 and a spring 365 inserting a passive portion into a groove 360 of the top end of the iron core 352, and impelling the lever 362 and the iron core 352 having a groove accommodating the clamp pin 358 to protrude. According to this configuration, when the solenoid 354 is not excited, the iron core 352 is impelled to protrude by the spring 365, and therefore, the clamp pin 358 is pivotally moved clockwise by the crank 356 in FIG. 11 with the axes 336 and 338 as a center.

The second gate body 340 is blocked in advancing by a second stopper 360 formed at the lateral side of the second fixed guide rail 252-2, and comes to rest, and is held at the guide position GP. In this case, the movable guide rail 254-1 is in a line so as to be approximately in range with the first fixed guide rail 252-1 and the second fixed guide rail 252-2. Further, since the movable guide rail 254-1 is inclined, a step is arisen with the second fixed guide rail 252-2. Hence, when the coin moves from the second fixed guide rail 252-2 to the second movable guide rail 254-2, an upward inclined guide surface 362 is formed on the upstream side end surface of the second movable guide rail 254-2 from the upstream side toward the downstream side, so that the coin can smoothly move.

Further, the third fixed guide rail 252-3 of the downstream side is also formed with an upward inclined fixed guide surface 363 from the upstream side toward the downstream side. When the movable guide rail 252-1 is positioned at the guide position GP2, the lower side peripheral surface of the coin moving while contacting the slide plate 224 at the lower surface is guided by the first movable guide rail 254-1 following the first fixed guide rail 252-1. Since the coin has the guide surface 283 of its upper surface inclined in the movable guide rail 252-1, the coin is given a component force so as to be further pushed by the first slide guide 242 and the first movable slide guide 248-1.

Consequently, the coin is moved by the push-to-move pin 238, while the lower side peripheral surface is guided by the fixed guide rail 252-1 and the first movable guide rail 254-1. The coin of the predetermined denomination in the midst of being pushed and moved by the push-to-move pin 238 drops off below by the self-load since the coin is not guided by the movable guide rails 254-1, 254-2, 254-3, 254-4 or 254-5 when the movable guide rails 254-1, 254-2, 254-3, 254-4 or 254-5 move to a non-guide position NP2. The dropped coin is guided to a guide passage 370, and is returned to a receiving port 442 through a predetermined coin storage payment device to be described later or a payout device 114.

Similarly to the present invention, when one side of the transferring device 108 is disposed with the first selecting portion 260, and the other side is disposed with the second selecting portion 262, a coin can be separated into the upper side and the lower side at the same distance from the denomination discriminating device 106 of the transferring device 108, and therefore, there is an advantage in that the transferring distance of the coin for separation by denomination can be made short, and the coin deposit payment device 100 can be made compact.

The gate bodies 290 and 340 opposite to each of the coin selecting ports 264, 266, 268, 270, 274, 276, 278, 280, and 282 are selectively moved to the guide position GP and GP2 or the non-guide position NP and NP2 by a timing signal from the first timing sensor 176 and the second timing sensor 217 based on the discriminated authenticity and coin discrimination information discriminated by the data detected by the denomination discriminating device 106.

Next, the control method of the gate bodies 290 and 340 will be described. That is, the control method of the guide positions GP and GP2 or the non-guide position NP and NP2 of the first movable guide plate 248-1, the second movable guide plate 248-2, the third movable guide plate 248-3, and the fourth movable guide plate 248-4, the first movable guide rail 254-1, the second movable guide rail 254-2, the third movable guide 254-3, the fourth movable guide 254-4, and the fifth movable guide 254-5 will be described. In other words, it is a control method of selectively moving the movable guide plates 248-1, 248-2, 248-3, and 248-4 or the movable guide rail 254-1, 254-2, 254-3, 254-4, and 254-5 of the relevant denomination to the non-guide position NP or NP2 based on the authenticity and the denomination information discriminated by the denomination discriminating device 106.

First, a coin passing through the movement route 190 pushed by the push-to-move lever 184 has data regarding a material quality, a diameter, and a thickness obtained by the magnetic sensor 160, and in a control device 432, the authenticity is discriminated, and in the case of an authenticated coin, the denomination thereof is discriminated, and both of them are stored in association with a pulse signal TP from the timing sensor 176 outputted immediately after the discrimination. In the case of a fraudulent coin, immediately after it is discriminated as the fraudulent coin, it is stored in association with an initial timing signal TP1 outputted by blocking an optical axis of the timing sensor 176 by the push-to-move lever 184.

Next, when it is detected from the timing signal TP1 that a second timing signal TP2 from the second timing sensor 217 is transmitted for a predetermined number, a solenoid 364 of the first movable guide rail 254-1 is excited, and the iron core 352 is brought in. As a result, the axis 338 is pivotally moved counter-clock wise in FIG. 10 through the clamp pin 358 and the crank 356, and therefore, the first movable guide rail 254-1 moves below the first guide plate 244 from between the first fixed guide rail 252-1 and the second fixed guide rail 252-2, and is positioned at the non-guide position NP2.

This movement of the first movable guide rail 254-1 is performed by taking a sufficient time so that it is completed before a fraudulent coin reaches the reject selection port 274. The fraudulent coin pushed by the push-to-move pin 238 with its lower side peripheral surface guided by the first fixed guide rail 252-2, and further, supported and transferred by the first fixed guide plate 246-1 and the first movable guide plate 248-1 is not guided by the first movable guide rail 254-1, and therefore, drops into the selecting port 264 by its self-load, and is guided by the guide passage 370, and drops onto a belt 444 of the payment device 114.

After the timing signal TP1 is outputted from the first timing sensor 176, and when the predetermined number of second timing signals TP2 is received from the second timing sensor 217, the solenoid 350 is demagnetized, and the iron core 352 is poked out by the spring 365. As a result, the first movable guide rail 254-1 returns to the guide position GP2 between the first fixed guide rail 252-1 and the second fixed guide rail 252-2, and prepares for the selection of the next coin.

When the discriminated coin is a 5 cent coin, immediately after the discrimination, it is stored based on the timing signal TP1 from the timing sensor 176. When the second timing signal TP2 is outputted from the initial timing signal TP1, and moreover, the predetermined number of second timing signals TP2 is outputted from the second timing sensor 217, the solenoid 308 of the second movable guide plate 248-2 is excited, and the iron core 310 is brought in. As a result, the axis 298 is pivotally moved counter-clock wise in FIG. 10 through the clamp pin 316 and the crank 318, and therefore, the second movable guide plate 248-2 moves to the non-guide position NP of the first movable guide plate 248-1 shown in FIG. 10.

Consequently, the lower side peripheral surface is guided by the second fixed guide rail 252-2 and the second movable guide rail 254-2, and the lower surface is supported by the first slide guide 242 and the second fixed guide plate 246-2, and the 5 cent coin push-moved by the push-to-move pin 238 is not supported by the second movable guide plate 248-2 in the 5 cent selecting port 266, and therefore, drops into the 5 cent selecting port 266.

When the predetermined number of signals is outputted from the second timing sensor 217, since the solenoid 308 is demagnetized and the iron core 316 is poked out by the spring 310, the second movable guide plate 248-2 is returned to the guide position GP. Similarly, when the 10 cent coin or the 2 Euro coin is discriminated, the third timing signal TP1 is outputted from the initial timing signal TP1, and after that, when the predetermined number of second timing signals TP2 is inputted, in case the third movable guide plate 248-3 of the 10 cent selection port 168 or the third movable guide rail 254-3 of the 2 Euro selecting port 278 is moved to the non-guide position NG, and after that, in case the second timing signal is inputted for the predetermined number, the third movable guide plate 248-3 or the third movable guide rail 254-3 is moved to the guide position GP or GP2.

Similarly, when the 20 cent coin or the 50 cent coin is discriminated, the fourth timing signal TP1 is outputted from the initial timing signal TP1, and after that, when the predetermined number of second timing signals TP2 is inputted, the fourth movable guide plate 248-4 of the 20 cent selecting port 170 or the fourth movable guide rail 254-4 of the 50 cent selecting port 280 is moved to the non-guide position NP or NP2, and after that, when the second timing signal is inputted for the predetermined number, the fourth movable guide plate 248-4 or the fourth movable guide rail 254-4 is moved to the guide position GP or GP2, see FIG. 10.

Similarly, when the 1 Euro coin is discriminated, the fifth timing signal TP1 is outputted from the initial timing signal TP1, and after that, when the predetermined number of second timing signals TP2 is inputted, the fifth movable guide plate 248-5 of the 1 Euro selecting port 282 is moved to the non-guide position NP2, and after that, when the second timing signal is inputted for the predetermined number, the fifth movable guide rail 254-5 is moved to the guide position GP.

Next, a first passage sensor 400, a second passage sensor 402, a third passage sensor 404, a fourth passage sensor 406, a fifth passage sensor 408, and a sixth passage sensor 410 will be described. The passage sensors 400, 402, 404, 406, 408, and 410 have the functions of detecting the coin moving on the moving route by the transferring device 108.

Figure 11:
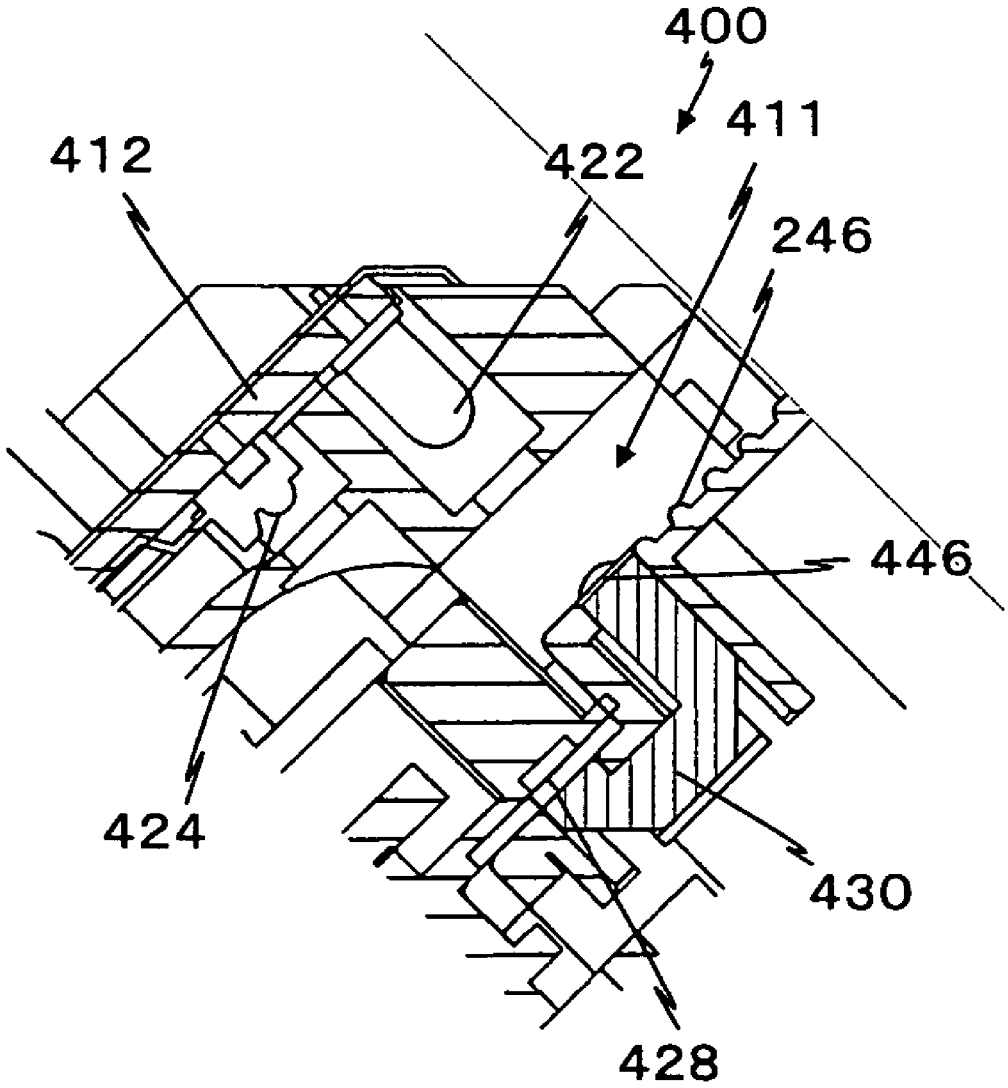
FIG. 11 is an enlarged sectional view of the coin sensor of a first selecting portion of the distribution device for each denomination of the coins.

A passage cover 412 opposite to a passage 411, through which the coin guided by the guide rail 226 moves, is disposed with the first passage sensor 400 facing the passage 411 just before the 2 cent selecting port 274, the reject selecting port 274, and the movement route 210 of the push-to-move pin 238, see FIG. 11. Just before the 5 cent selecting port 266, the second passage sensor 402 for the 5 cent selecting port 266 and the 1 cent selecting port 276 are disposed similarly to the first passage sensor 400.

Just before the 10 cent selecting port 268, the third passage sensor 404 for the 10 cent selecting port 268 and the 2 Euro selecting port 278 are disposed similarly to the first passage sensor 400. Just before the 20 cent selecting port 270, the fourth passage sensor 406 for the 20 cent selecting port 270 and the 50 cent selecting port 280 are disposed similarly to the first passage sensor 400. Just before the 1 Euro selecting port 282, the fifth passage sensor 408 for the 1 Euro selecting port 282 is disposed similarly to the first passage sensor 400.

Just before the overflow selecting port 272, the overflow reaching sensor 410 is disposed similarly to the first passage sensor 400. The overflow selecting port 272 is formed in a size where the maximum coin presumed to be used is droppable so that the coin storing portion 112 stores the coins of the predetermined denomination which are overflowed, and no gate is disposed.

Next, the structures of the passage sensors 400, 402, 404, 406, 408, and 410 will be described with reference mainly to FIG. 11. The passage sensors 400, 402, 404, 406, 408, and 410 have the functions of detecting an object moving on the passage 411 and the movement route 210. Since the passage sensors 400, 402, 404, 406, 408, and 410 are of the same configuration, a description will be made by adopting the first passage sensor 400 as a representative.

The light-projecting element 422, the light-receiving element 424, and a light-receiving surface 446 fixed to a sensor base 412 disposed at the upper side of the route 240 are flush-mounted with each fixed slide plate 246, and have a light guide 430 disposed with the light projecting surface 428 slightly below the fixed slide plate 246. The light guide 430, for example, is a prism made of transparent resin.

Consequently, the light projected from the light-projecting element 422 crosses over the passage 411 of the coin, and enters the light-receiving surface 446, and after that, is guided by the optical guide 430, and is projected from the light-projecting surface 428, and crosses over the passage 411 of the coin again, and enters the light-receiving element 424.

Consequently, the passage sensor 400 is preferably a sensor of a light transmission type. This is because the maintenance of the light-projecting and receiving surfaces and the detection malfunction due to dust and the like are little. Coin detection signals from the passage sensors 400, 402, 404, 406, 408, and 410 are inputted to the control device 432, and are used for discrimination that the coins are selected at the predetermined selecting ports.

Next, the method of discriminating the dropping of the coin in the control device 432 into the predetermined selecting port will be described.

When a true coin of which denomination is discriminated by the coin denomination discriminating device 106 drops into the selecting port of the first selecting portion 260 is indirectly discriminated by the passage sensor disposed at the upper stream and the passage sensor disposed at the down steam of the selecting port. For example, the dropping of the 2 cent coin into the 2 cent selecting portion 264 is discriminated when the first passage sensor 400 detects the passage of the coin and the second passage sensor 402 does not detect the passage of the coin during the predetermined period after the passage of the coin through the first passage sensor 400.

When the second passage sensor 402 detects the passage of the coin during the predetermined period after the passage of the coin through the first passage sensor 400, the 2 cent coin is discriminated as not dropped into the 2 cent selecting port 264. In this case, a gate device of any of the selecting ports is not opened, and the coin finally drops into the overflow selecting port 272. Consequently, when the sixth passage sensor 410 detects the passage of the coin, the coin is discriminated as dropped into the overflow selecting port 272.

That the 5 cent coin drops into the 5 cent selecting port 266 is discriminated by the presence or absence of the coin detection signal from the second passage sensor 402 and the third passage sensor 404 as described above. That the 10 cent coin drops into the 10 cent selecting port 268 is discriminated by the presence or absence of the coin detection signal from the third passage sensor 404 and the fourth passage sensor 406 as described above.

That the 20 cent coin drops into the 20 cent selecting port 270 is discriminated by the presence or absence of the coin detection signal from the fourth passage sensor 406 and the fifth passage sensor 408 as described above. That the 1 Euro coin drops into the 1 Euro selecting port 282 is discriminated by the presence or absence of the coin detection signal from the fifth passage sensor 408 and the sixth passage sensor 410 as described above. The coin detected by the passage sensor 410 is regarded as dropped into the overflow selecting port 272. The overflow selecting port 272 is formed to be far larger than a coin supposed to be processed so that it may be regarded as surely dropped.

The method of discriminating the dropping of the coin by the sensors disposed before and after the passage of the selecting port of the coin in this manner has the advantage that the device can be made compact. However, the dropped coin can be directly detected by the sensors disposed in the guide passage to each storing portion from each selecting port.

That a true coin of which the denomination is discriminated by the coin denomination discriminating device 106 drops into the selecting ports 274, 276, 278, 280 or 282 of the second selecting portion 262 is directly discriminated by the passage sensors 442, 444, 446, 448, and 450 disposed at the slide plate 440 configuring the guide passage 370 and inclined downward. The passage sensors 442, 444, 446, 448 or 450 are disposed at each guide passage 370 communicated with each of the selecting ports 274, 276, 278, 280 or 282, and are of the same structure.

Figure 12:
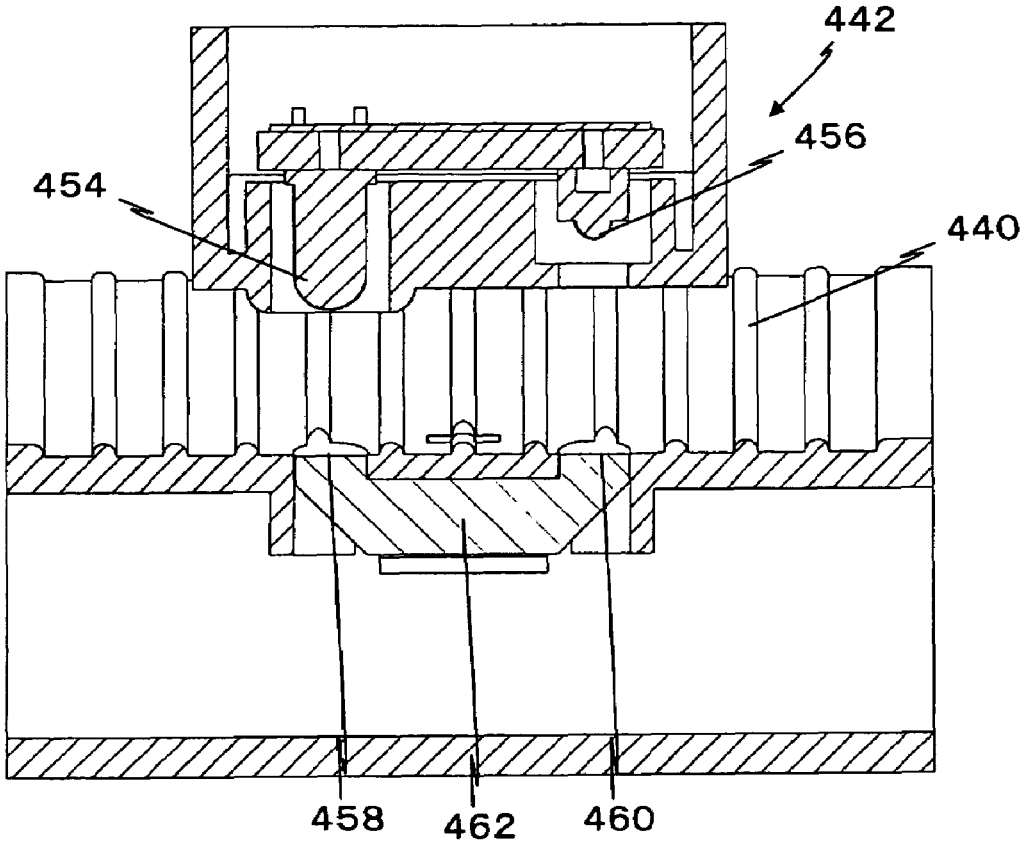
FIG. 12 is an enlarged sectional view of the coin sensor of the distribution device for each denomination of the coins.

Next, since the structures of the passage sensors 442, 444, 446, 448, and 450 are of the same structures, a description will be made with reference to the passage sensor 442 shown in FIG. 12. The passage sensor 442 includes: a light-projecting element 454 fixed to a sensor base 452 disposed at the upper side of the guide passage 370; a light-receiving element 456; and an optical guide 462 including a light-receiving surface 458 and the light-projecting surface 460 flush-mounted with each slide plate 440. The optical guide 462, for example, is a prism of made of transparent resin.

Consequently, the light projected from the light-projecting element 454 crosses over the guide passage 370 and enters the light-receiving surface 458, and after that, is guided by the optical guide 462, and is projected from the light-projecting surface 460, and crosses over the guide passage 370 again, and enters the light-receiving element 456. Consequently, each of the passage sensors 442, 444, 446, 448, and 450 is preferably a sensor of a light transmission type. This is because the maintenance of the light-projecting and receiving surfaces and the detection malfunction due to dust and the like are little.

Coin detection signals from each of the passage sensors 442, 444, 446, 448, and 450 are inputted to the control device 432, and are used for discrimination that the coins are selected at the predetermined selecting ports. For example, that the fraudulent coin drops into the reject selection port 274 is detected by a projected light to the light-receiving surface 458 from the light-projecting element 454 of the passage sensor 422 or the blocking by the coin of the one or both of the projected lights to the light-receiving element 456 from the light projecting surface 460.

Next, the coin storing portion 112 will be described. The coin storing portion 112 has the functions of storing the coins selected for each denomination in the selecting portion 110 according to each denomination. In the present embodiment, the coin storing portion 110 is configured by arranging in two rows the coin hoppers 470 paying out the coins one by one by a rotating disk (not shown) for each denomination by facing the first selecting portion 260 and the second selecting portion 262 below the selecting portion 110. Each coin hopper displays reference numeral 470 attached with a symbol for each denomination.

Next, the payout device 114 shown in FIG. 2 will be described.

The payout device 114 has the functions of transferring the coins paid out from the coin hopper 470 for each denomination to a payout tray 472, see FIG. 1. In the present embodiment, the payout device 114 is a flat belt 474 disposed between the coin hopper arranged in two rows. The flat belt 474 is selectively driven by an electric motor 476 so that the upper surface thereof moves toward the payout tray 472. The coin transferred by the flat belt 474 is supplied into the payout tray 472.

Next, the operation of the present embodiment will be described. When the coins of multiple denominations are inputted to the input port 120, the inputted coins drop on the deposit flat belt 122. As a result, an optical axis of the deposit detection device 128 is blocked by the inputted coin, and therefore, a deposit detection signal is outputted, and the motor 126 is rotated by the deposit detection signal. Consequently, the upper surface of the deposit flat belt 122 moves to the separate feeding device 104 side, and therefore, the coin drops from the end portion of the deposit flat belt 122, and drops into the storing bowl 132 of the separate feeding device 104.

If the coins are overlapped and transferred, since the break-up roller 124 is reversely rotated, the lower surface of the roller 124 is moved in a direction reverse to the movement of the upper surface of the deposit flat belt 122, and therefore, any heaped-up coins are blocked in advancing by the break-up roller 124, and are dropped back on the belt 122. The dropped coins are transferred to the separate feeding device 104 again by the travel of the deposit flat belt 122 similarly as described above. When the deposit sensor 128 does not detect a coin, the motor 126 is stopped, and the drive of the deposit flat belt 122 is stopped.

Further, a motor 150 is rotated by the deposit detection signal of the deposit detection device 128, and the gear 154 starts a rotation at a predetermined speed through a speed reducer 152. Consequently, the driven gear 158 engaging with the gear 154 is rotated, and the circular disk 140 is rotated counter-clock wise in FIG. 4.

The push-to-move lever gear 216 is engaged with the driven gear 158 through its rotation rotates clock-wise in synchronization. That is, the rotating body 172 rotates clock-wise in FIG. 4 in association with the circular plate 140 at a transfer ratio 1:1. Further, the driven gear 239 is rotated by the gear 216, and therefore, the first sprocket 228 is rotated counter-clock wide in FIG. 6 through the axis 237. As a result, the chain 232 is circulated counter-clock wise.

Consequently, the coins dropped into the storing bowl 132 are agitated by the plate 146 and a push-out body 148, and changes its posture in various manners. In the process of its posture changes, only one piece of the coin is accommodated in each accommodating portion 138. That is, one side of the coin is positioned in the accommodating portion 138 in a state of a facial contact with the rotating plate 140, and is pushed by a part of the side surface of the plate 146, and is moved together with the rotation of the rotating circular plate 140.

The push-out body 148 is pivotally moved counter-clock wise immediately after the accommodating portion 138 passes through the top position, and moves in a peripheral direction of the rotating circular plate 140. As a result, the coin positioned in the accommodating portion 138 is pushed out by the push-out body 148 in the peripheral direction of the rotating circular plate 140. The pushed out coin, immediately after guided by the accommodating body 134, is pushed out by the push-to-move lever 184 of the rotating body 172 rotated in association with the rotating circular plate 140.

When a coin dropped into the storing bowl 132 exceeds the predetermined amount, a full coin signal is outputted from the full coin sensor 136. By this full coin signal, the motor 126 is stopped even if the deposit detection device 128 detects an inputted coin, and the excessive inputting of coins to the separate feeding device 104 is avoided.

The coin inside the storing bowl 132 is fed out by the rotation of the rotating plate 130, so that the full coin signal is not outputted from the full sensor 136, and moreover, when the deposit detection device 128 outputs a deposit signal, the motor 126 is activated again, and the coin on the deposit flat belt 122 is supplied to the separate feeding device 104.

The coin pushed by the push-to-move lever 184 moves on the movement route 190, while contacting the slide base 170 by one side. At this time, since the push-out portion 206 makes a sharp angle at the reference guide 174, the coin receives a force by which it is pushed out in the peripheral direction, and by the centrifugal force of the coin itself, the coin peripheral surface moves, while being pushed to the straight-line guide portion 188.

In this movement process, first, the upper and lower surfaces of the coins are opposite to the upper and lower thickness sensors 164. At the same time, though the small diameter coins such as the 1 cent and the like are not opposite, the medium and the large diameter coins such as the 50 cent, the 2 Euro coin and the like are opposite to the upper and lower second diameter sensors 194 in the upper portions of the coins.

Next, the push-moved coins are moved opposite to the upper and lower material quality sensors 162 in the upper and lower entire surfaces, and slightly late, are opposite to the entire surface or one side of the upper and lower first diameter sensor 192 and the upper and lower third diameter sensor 196. Consequently, the output of the coil of the thickness sensor 164 changes by receiving the effect of the thickness of the coin, and each coin of the second diameter sensor 194, the first diameter sensor 192, and the third diameter sensor 196 changes in the output by receiving the effect for a relative area with the coin, and the material quality sensor 162 changes in the output by receiving the effect of the material quality.

Hence, by comparing the outputs of these sensors 162, 164, 192, 194, and 196 with the reference value, it is possible to discriminate the authenticity and denomination of each coin. Particularly, since the coin is always guided by the straight-line guide portion 188 of the reference guide 174, the relative position between the coin and each sensor is the same for each time. In other words, since the sampling data of the coin of the same denomination is the same, it is possible to perform highly accurate discrimination.

Further, since any of the slide base 170, the rotating body 172, and the upper cover 208 is made of a non-magnetic material, the magnetic flux generated by the coil of each sensor is not affected by these materials, and therefore, the output of the coil is affected only by the metal properties of the coin. Consequently, the quality of the sampling data is high even by this fact, and therefore, it is possible to perform highly accurate discrimination.

Figure 7:
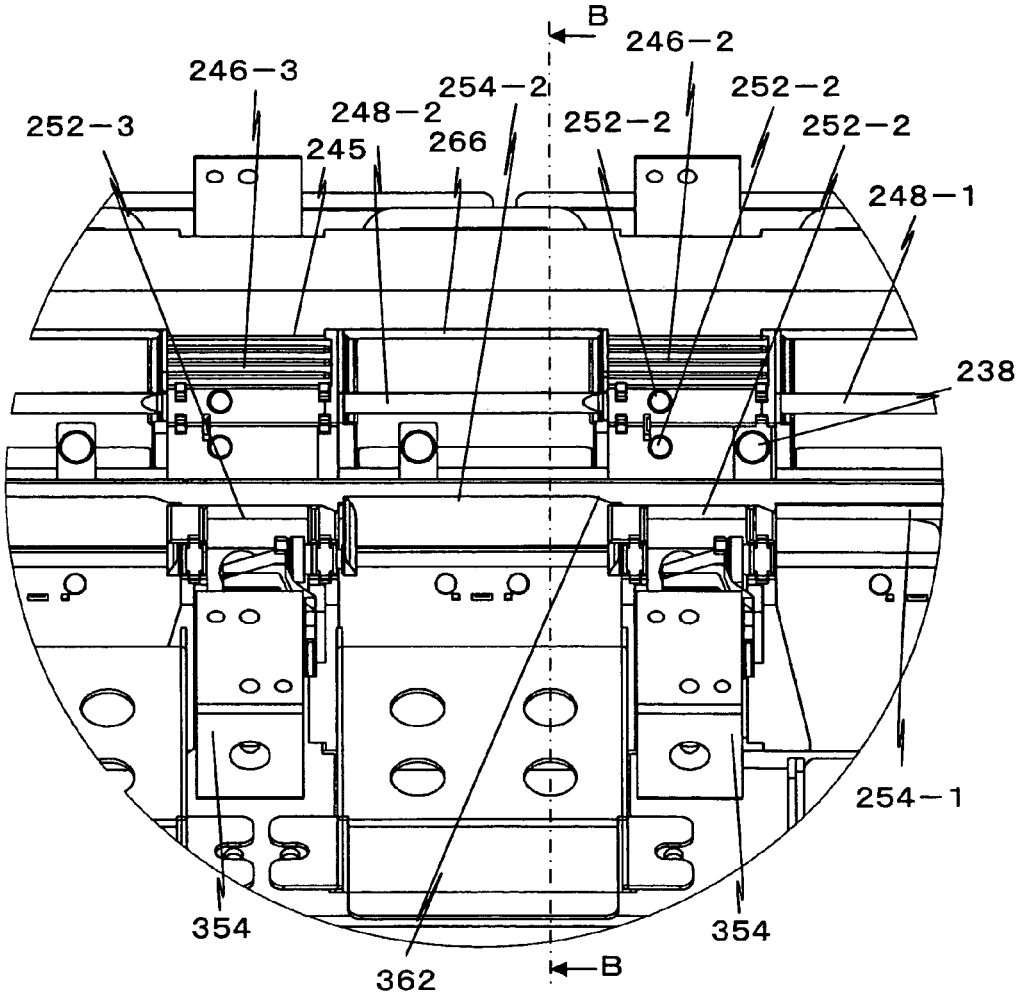
FIG. 7 is a partially enlarged front view of a selecting portion of the distribution device for each denomination of the coins.

As shown in FIG. 7, immediately after the maximum diameter portion of the coin is opposite to the first diameter sensor 192 and the third diameter sensor 196, a discriminating circuit (not shown) outputs a first denomination signal D1. When the coins are continuously discriminated, a second denomination signal D2 is outputted, and subsequently, the denomination signals are similarly outputted.

Figure 2:
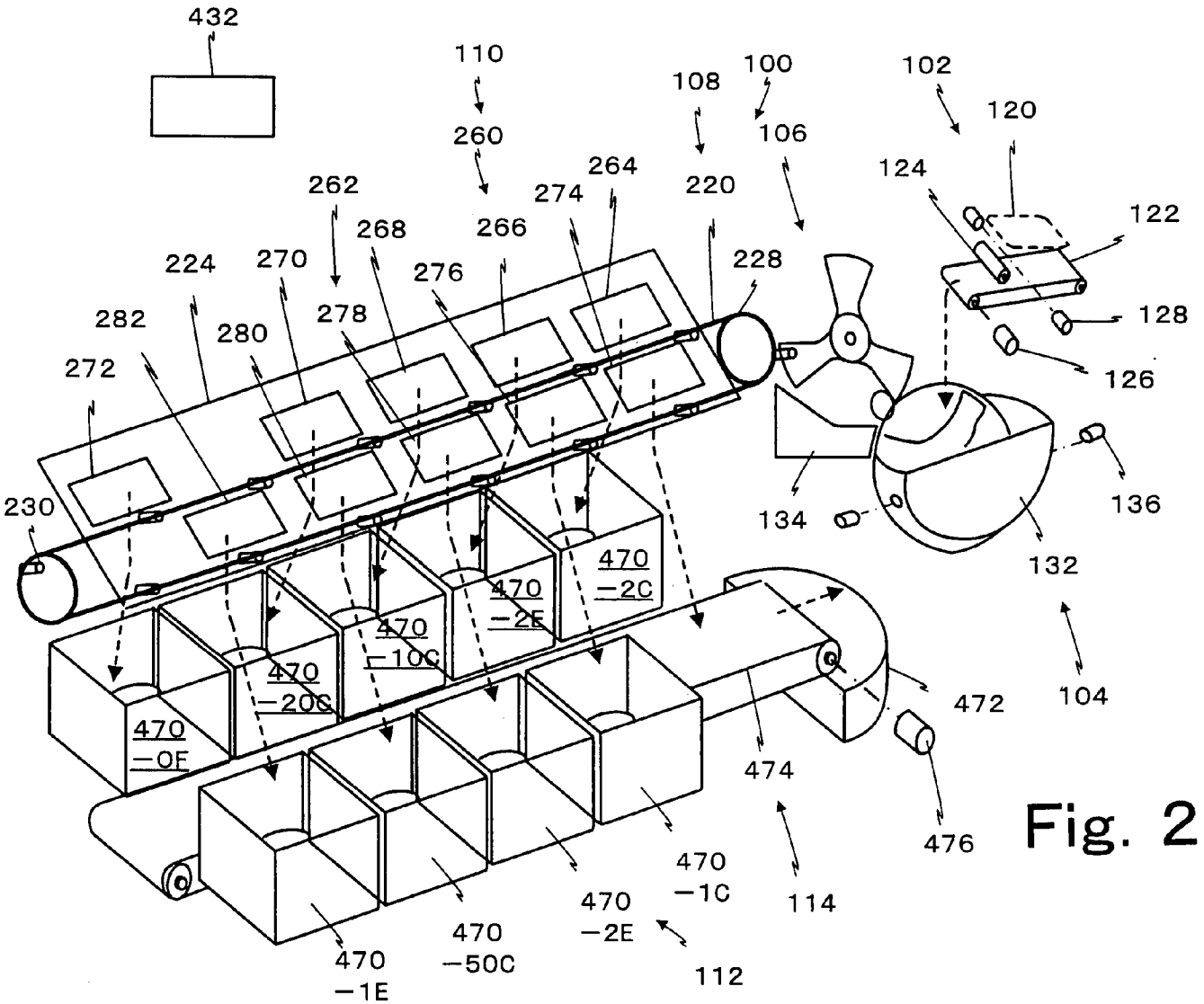
FIG. 2 is a schematic outline explanatory drawing of a coin route of a coin deposit payment machine with the distribution device for each denomination of the coins.

Immediately after the first denomination signal D1 is outputted, by one of the push-to-move levers 184, the optical axis of the first timing sensor 176 is shut off, and therefore, the timing sensor 176 outputs the timing signal T1 of "H." In association with this timing signal T1, the first denomination signal D1 is stored in the control device 432, see FIG. 2.

After movement opposite to the material quality sensor 162, the coin is pushed out to the movement route 240 of the push-to-move pin 238 by the transferring device 108 and the push-to-move lever 184. The coin, immediately after being pushed out by the movement route 240, is pushed out by the push-to-move pin 238 moved by the chain 232. As a result, the coin has the peripheral surface guided by the guide rail 226, while one side is facially contacted by the slide plate 224, and then, is moved on the passage 411.

While the coin is in the midst of being moved on the passage 411, based on the coin denomination signal stored in association with the timing signals T1, T2, . . . of the first timing sensor 176 and a second timing sensor hopper 4701, a hopper 4702 . . . , as described above, the gates 248-1 248-2, 248-3, and 248-4 and 254-1, 254-2, 254-3, 254-4, and 254-5 corresponding to the selecting ports 264, 266, 268, 270, 274, 276, 278, 280, and 282, are operated, and the coin of the predetermined denomination is dropped into the predetermined selecting port.

Figure 13:
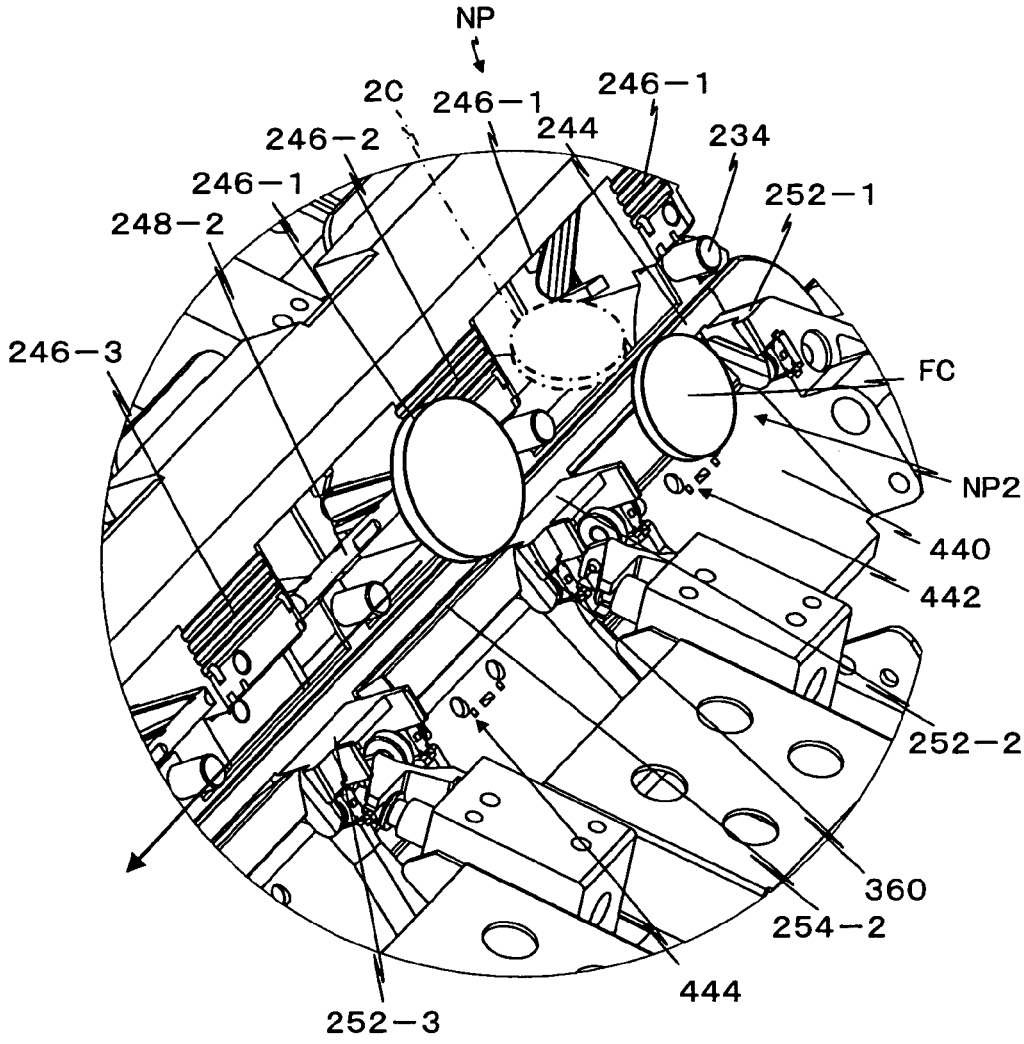
FIG. 13 is an operation explanatory drawing deleting a part of parts of the distribution device for each denomination of the coins.

Specifically, in the case of a fraudulent coin FC, when the first timing signal T1 is outputted, and after that, the second timing signal hopper ST is outputted for the predetermined number, the solenoid 350 is excited, and the first guide rail 254-1 is moved to the non-guide position NP2 (see FIG. 13). Immediately after the first movable guide rail 254-1 is moved to the non-guide position NP2, the coin push-moved by the push-to-move pin 238 reaches the first movable guide rail 254-1, and further, after that, when a second timing signal ST is outputted for the predetermined number, the solenoid 350 is demagnetized, and the first guide rail 254-1 is moved to the guide position GP2.

As a result, the fraudulent coin FC is moved along the guide rail 226 and is not guided or supported by the first movable guide rail 254-1, and therefore, drops into the reject selecting port 274, and is guided by the guide passage 370 so as to drop on the flat belt 474, and is returned to the payout tray 472 by the flat belt 474 performing the transferring movement by being activated by the deposit signal of the deposit detection device 128.

When the discriminated denomination is the 2 cent coin, the gate of the selecting port 264 based on a signal T1 outputted from the first timing sensor 176 and a signal ST2 outputted from the second timing sensor 217, the first movable guide plate 248-1 is moved to the non-guide position NP (see FIG. 13). Hence, the 2 cent coin moved while being guided by the guide rail 226 collapsingly drops into the selecting port 264, and after that, is guided by the guide passage 323 and stored in a 2 cent hopper 470-2C.

When the discriminated denomination is the 5 cent coin, the second guide plate 248-2 of the selecting port 266 is opened for a predetermined period of time based on the signals outputted from the first timing sensor 176 and the second timing sensor 217. Hence, the 5 cent coin moved while being guided by the guide rail 226 drops into the selecting port 266, and after that, is guided by the guide passage 323 and stored in a 5 cent hopper 470-5C.

When the discriminated denomination is the 1 cent coin, the second movable guide rail 254-2 of the selecting portion 276 is moved to the non-guide position NP2 based on the signals outputted from the first timing sensor 176 and the second timing sensor 217, and is opened for a predetermined period of time. Hence, the 1 cent coin moved while being guided by the guide rail 226 drops into the 1 cent selecting port 276, and after that, is guided by the guide passage 370 and stored in a 1 cent hopper 470-1C.

When the discriminated denomination is the 10 cent coin, the second guide rail 248-3 of the selecting port 268 is moved to the non-guide position NP based on the signals outputted the timing sensor 176 and the second timing sensor 217. Hence, the 10 cent coin moved while being guided by the guide rail 226 drops into the selecting port 268, and after that, is guided by the guide passage 323 and stored in a 10 cent hopper 470-10C.

When the discriminated denomination is the 2 Euro coin, the third guide rail 254-3 of the selecting port 278 is positioned at the non-guide position NP2 for a predetermined period of time based on the signals outputted from the timing sensor 176 and the second timing sensor 217. Hence, the 2 Euro coin moved while being guided by the guide rail 226 drops into the selecting port 278, and after that, is guided by the guide passage 370 and stored in a 2 Euro hopper 470-2E.

When the discriminated denomination is the 20 cent coin, the fourth guide rail 248-4 of the selecting port 270 is positioned at the non-guide position NP for a predetermined period of time based on the signals outputted from the timing sensor 176 and the second timing sensor 217. Hence, the 20 cent coin moved while being guided by the guide rail 226 drops into the 20 cent coin selecting port 270, and after that, is guided by the guide passage 323 and stored in a 20 cent hopper 470-20E.

When the discriminated denomination is the 50 cent coin, the fourth guide rail 254-4 of the selecting port 280 is positioned at the non-guide position NP2 for a predetermined period of time based on the signals outputted from the timing sensor 176 and the second timing sensor 217. Consequently, the 50 cent coin moved while being guided by the guide rail 226 drops into the selecting port 280, and after that, is guided by the guide passage 370 and stored in a 50 cent hopper 470-50C.

When the discriminated denomination is the 1 Euro coin, the fifth guide rail 254-6 of the selecting port 282 is positioned at the non-guide position NP2 for a predetermined period of time based on the signals outputted from the timing sensor 176 and the second timing sensor 217. Hence, the 1 Euro coin moved while being guided by the guide rail 226 drops into the selecting port 282, and after that, is guided by an unillustrated shut and stored in a 1 Euro hopper 470-1E.

When the coin storing amount of any of the hoppers is equal to or more than a predetermined amount, in other words, in an overflow state, the guide plate and the guide rail of the corresponding selection port are not opened. In other words, the coin does not drop into any of the selecting ports, but into the overflow selecting port 272, and is stored in an overflow hopper 470-0F.

The detection signal of the overflow reaching sensor 410 is used as a signal confirming that the coin reaches the overflow hopper 470-0F. Consequently, the coin inputted to the input port 120 is selected for the predetermined selecting port based on the denomination discriminated by the denomination discrimination device 106.

When the predetermined denomination is paid out for the determined number, first, the flat belt 474 upper surface is driven by the motor 476 so as to move to the payout tray 472. Next, the predetermined number of coins is paid out from the hopper of the predetermined denomination, and is fed to the payout tray 472 by the flat belt 474.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin distribution device for separating coins of different denominations comprising:

a storage member for storing coins in bulk;

a separator feeding device for removing coins from the storage member in a one by one manner;

a coin denomination unit determines the coin denominations;

a transfer device for translating the coins from the coin denomination unit along a transfer path in one direction;

an inclined guide plate forming a portion of the transfer path including a first selecting port, and a first moveable gate located within the first selecting port and aligned with the inclined guide plate for one of releasing a first coin denomination from the transfer path and transferring other coin denominations, wherein the inclined guide plate and first movable gate supports and guides a side of each of the coins of different denominations;

a guide rail forming another portion of the transfer path including a second selecting port, and a second moveable gate located within the second selecting port and aligned with the guide rail for one of releasing a second coin denomination from the transfer path and transferring other coin denominations, wherein the guide rail and second movable gate supports and guides a peripheral edge of the coins of different denominations and wherein the first selecting port and the second selecting port are located adjacent each other at the same location on the transfer path wherein the first coin denomination and the second coin denomination are selectively released from the transfer path;

a transfer device located between the guide rail and the inclined guide plate, the transfer device including a plurality of pusher pins moving the coins of different denominations guided by the inclined guide plate and supported by the guide rail along the predetermined direction; and an activating unit selectively opening the first moveable gate and the second moveable gate in accordance with a denomination of each coin in the coins of different denominations for release at the same location to shorten the length of the transfer path.

2. The coin distribution devices of claim 1 wherein the first moveable gate is a moveable guide plate and the second moveable gate is a moveable guide rail.

3. The coin distribution device of claim 1 wherein the activating unit moves the first moveable gate to enable a coin to fall into the first selecting port.

4. The coin distribution device of claim 3 wherein the activating unit moves the second moveable gate to enable a coin to fall into the second selecting port.

5. The coin distribution device of claim 4 wherein the coins are separated by the plurality of pusher pins when the coins are moved in the predetermined direction.

6. The coin distribution device of claim 5 wherein the transfer device includes an endless chain mounting the pusher pins.

7. A coin distribution device for a plurality of coin denominations, comprising:

a coin denomination unit determining an individual denomination of each coin of a plurality of coins of multiple denominations;

a transferring device for moving the plurality of coins in a single predetermined direction along a transfer path;

an inclined guide plate for guiding a side surface of the coins moved by said transferring device along the transfer path;

a first selecting port configuring a part of the guide plate;

a guide rail forming another portion of the transfer path and disposed at a lower side of the guide plate for guiding a peripheral edge surface of the plurality of coins;

a first movable guide plate located at the first selecting port and aligned with the inclined guide rail for one of releasing a first coin denomination form the transfer path and transferring other coin denominations, wherein the inclined guide plate and the first movable guide plate supports and guides the side surface of each of the coins of different denominations of the plurality of coins;

a second selecting port; and a first movable guide rail located at the second selecting port and aligned with the guide rail for releasing a second coin denomination from the transfer path and transferring other coin denominations wherein the guide rail and the first movable guide rail support and guide the peripheral edge surface of the coins of different denominations and wherein the first selecting port and the second selecting port are located adjacent each other at the same location on the transfer path wherein the fist coin denomination and the second denomination are selectively released from the transfer path; and a control device connected to the coin denomination unit for selectively moving the first moveable guide plate and the first moveable guide rail wherein one of the first moveable guide plate and the first moveable guide rail is moved to access the first selecting port or the second selecting port in response to the determination of the individual denomination of each coin of multiple different denominations by the coin denomination unit for release at the same location to shorten the length of the transfer path.

8. The coin distribution device of claim 7 wherein the transfer device includes an endless chain with a plurality of pusher pins mounted on the endless chain, the pusher pins guiding the coins in the predetermined direction.

9. The coin distribution device of claim 8 wherein the coin denomination unit includes a magnetic sensor unit to determine the individual denomination of each coin of the plurality of coins of multiple denominations.

10. The coin distribution device of claim 9 wherein the coin denomination unit transfers each coin of the plurality of coins of multiple denominations individually to the transfer device after the magnetic sensor unit determines the individual denomination of each coin of the plurality of coins of multiple denominations.

11. The coin distribution device of claim 10 further comprising:

a deposit device to receive the plurality of coins of multiple denominations; and a separate feeding device connected to the deposit device and the coin denomination unit to individually feed the coins of multiple denominations to the coin denomination unit.

12. The coin distribution device of claim 11 wherein the separate feeding device includes means for adapting to a size of each coin of the plurality of coins of multiple denominations and individually feeding each coin of the plurality of coins of multiple denominations to the denomination unit.

13. The coin distribution device of claim 12 wherein the denomination unit further includes a rotating plate with a plurality of fixed arms, the plurality of fixed arms individually receiving each coin of the plurality of coins of multiple denominations and individually feeding each coin of the plurality of coins of multiple denominations to one of the plurality of pusher pins.

14. The coin distribution device of claim 13 wherein the guide plate and the guide rail form two rows parallel to each other on opposite sides of the predetermined direction of the transfer path.

15. The coin distribution device of claim 14 wherein the predetermined direction is a straight line.

16. The coin distribution device of claim 15 wherein the predetermined direction is a straight line perpendicular to a direction of gravity.

* * * * *